US012805630B2

(12) United States Patent
Hu et al.

(10) Patent No.: US 12,805,630 B2
(45) Date of Patent: Nov. 24, 2026

(54) INSTALLATION SYSTEM FOR COOKING APPLIANCE AND METHOD FOR INSTALLING COOKING APPLIANCE

(71) Applicant: WHIRLPOOL CORPORATION, Benton Harbor, MI (US)

(72) Inventors: Jianan Hu, Shenzhen (CN); Bin Huang, Shenzhen (CN); Xin Li, Shenzhen (CN); Yu Liu, St. Joseph, MI (US); Xiangzhou Zhu, Shenzhen (CN)

(73) Assignee: Whirlpool Corporation, Benton Harbor, MI (US)

( * ) Notice: Subject to any disclaimer, the term of this patent is extended or adjusted under 35 U.S.C. 154(b) by 91 days.

(21) Appl. No.: 18/694,710

(22) PCT Filed: Sep. 23, 2021

(86) PCT No.: PCT/CN2021/119977
§ 371 (c)(1),
(2) Date: Mar. 22, 2024

(87) PCT Pub. No.: WO2023/044674
PCT Pub. Date: Mar. 30, 2023

(65) Prior Publication Data
US 2024/0398115 A1 Dec. 5, 2024

(51) Int. Cl.
*A47B 77/08* (2006.01)
*F24C 15/30* (2006.01)

(52) U.S. Cl.
CPC ..... *A47B 77/08* (2013.01); *F24C 15/30* (2013.01)

(58) Field of Classification Search
CPC ..... A47B 77/08; F24C 15/30; H05B 6/6429; Y10T 24/45628; Y10T 24/45634;
(Continued)

(56) References Cited

U.S. PATENT DOCUMENTS 1,247,258 A * 11/1917 Geisert ..... A44B 11/2519 24/648
1,326,543 A * 12/1919 Stenman ..... A44B 11/2523 24/635
(Continued)

FOREIGN PATENT DOCUMENTS

CN 2374775 Y 4/2000
CN 201251215 Y 3/2009
(Continued)

*Primary Examiner* — Matthew W Ing
(74) *Attorney, Agent, or Firm* — Price Heneveld LLP

(57) ABSTRACT

An installation assembly for a cooking appliance (12) includes a retaining assembly (22) defining a channel (24). The retaining assembly (22) includes a first side arm (104) and a second side arm (106) disposed adjacent to the first side arm (104). The first side arm (104) and the second side arm (106) are biased to a retracted position. A coupling assembly (30) is configured to couple to the cooking appliance (12). The coupling assembly (30) includes a coupling feature (130) having an insertion end (134) and a coupling end (136). A locking feature (140) is coupled to the insertion end (134). The locking feature (140) has a greater width compared to the coupling feature (130) to adjust the first side arm (104) and the second side arm (106) to an extended position as the coupling assembly (30) is inserted through the channel (24). The locking feature (140) is retained on the retaining assembly (22) in an installed position.

13 Claims, 18 Drawing Sheets

(58) Field of Classification Search
CPC ..... Y10T 24/45644; Y10T 24/45702; Y10T 24/45749; Y10T 24/45791; Y10T 24/45822; Y10T 24/45827
See application file for complete search history.

(56) References Cited

U.S. PATENT DOCUMENTS

| | | | | |
|---|---|---|---|---|
| 2,420,061 | A | 5/1947 | Adams | |
| 2,647,294 | A | 8/1953 | Davis | |
| 2,688,173 | A | 9/1954 | Peet | |
| 2,896,287 | A | 7/1959 | Stultz | |
| 4,313,043 | A | 1/1982 | White et al. | |
| 4,697,946 | A | 10/1987 | Röck et al. | |
| 4,720,622 | A * | 1/1988 | Iwata | F24C 15/30 219/391 |
| 4,753,406 | A | 6/1988 | Kodama et al. | |
| 4,814,571 | A | 3/1989 | Bowen et al. | |
| 5,584,595 | A | 12/1996 | Gantitano et al. | |
| 6,222,171 | B1 * | 4/2001 | Fukuda | F24C 15/30 219/757 |
| 6,512,214 | B2 | 1/2003 | Jeong et al. | |
| 7,030,348 | B1 | 4/2006 | Kim | |
| 7,345,264 | B2 | 3/2008 | Yoshidome | |
| 8,389,917 | B2 | 3/2013 | Jeong | |
| 2002/0050491 | A1 * | 5/2002 | Kim | H05B 6/6429 219/757 |

FOREIGN PATENT DOCUMENTS

| | | | |
|---|---|---|---|
| CN | 107316587 | A | 11/2017 |
| CN | 207784970 | U | 8/2018 |
| CN | 110574858 | A | 12/2019 |
| CN | 1451909 | A | 10/2023 |
| ES | 2142732 | A1 | 4/2000 |
| JP | S62187215 | A | 8/1987 |
| KR | 20040090774 | Y1 | 10/2004 |
| KR | 200372475 | Y1 | 1/2005 |
| KR | 20080057729 | A | 6/2008 |

* cited by examiner

INSTALLATION SYSTEM FOR COOKING APPLIANCE AND METHOD FOR INSTALLING COOKING APPLIANCE

BACKGROUND OF THE DISCLOSURE

The present disclosure generally relates to an installation assembly for an appliance, and more specifically, to an installation assembly for a cooking appliance and a method for installing the cooking appliance.

SUMMARY OF THE DISCLOSURE

According to one aspect of the present disclosure, an appliance installation system includes a support structure having an upper surface and a lower surface. The support structure defines at least one aperture. At least one retaining assembly is coupled to the upper surface of the support structure. The at least one retaining assembly defines a channel configured to align with the at least one aperture. A cooking appliance has a top surface and a bottom surface. At least one coupling assembly is coupled to the top surface of the cooking appliance. The at least one coupling assembly is disposed within the channel and retained in position by the at least one retaining assembly to install the cooking appliance to the support structure proximate to the lower surface.

According to another aspect of the present disclosure, an installation assembly for a cooking appliance includes a retaining assembly defining a channel. The retaining assembly includes a first side arm and a second side arm disposed adjacent to the first side arm. The first side arm and the second side arm are biased to a retracted position. A coupling assembly is configured to couple to the cooking appliance. The coupling assembly includes a coupling feature having an insertion end and a coupling end. A locking feature is coupled to the insertion end. The locking feature has a greater width compared to the coupling feature to adjust the first side arm and the second side arm to an extended position as the coupling assembly is inserted through the channel. The locking feature is retained on the retaining assembly in an installed position.

According to yet another aspect of the present disclosure, a method for installing a cooking appliance includes coupling a coupling assembly to a top surface of a microwave oven, coupling a retaining assembly to an upper surface of a support structure, inserting the coupling assembly through the support structure, automatically adjusting side arms of the retaining assembly to an extended position as the coupling assembly is inserted through the retaining assembly, automatically adjusting the side arms to a retracted position as the coupling assembly is further inserted through the retaining assembly, and retaining the coupling assembly in an installed position on the retaining assembly where the microwave oven is hanging from the support structure.

These and other features, advantages, and objects of the present disclosure will be further understood and appreciated by those skilled in the art by reference to the following specification, claims, and appended drawings.

Figure 1:
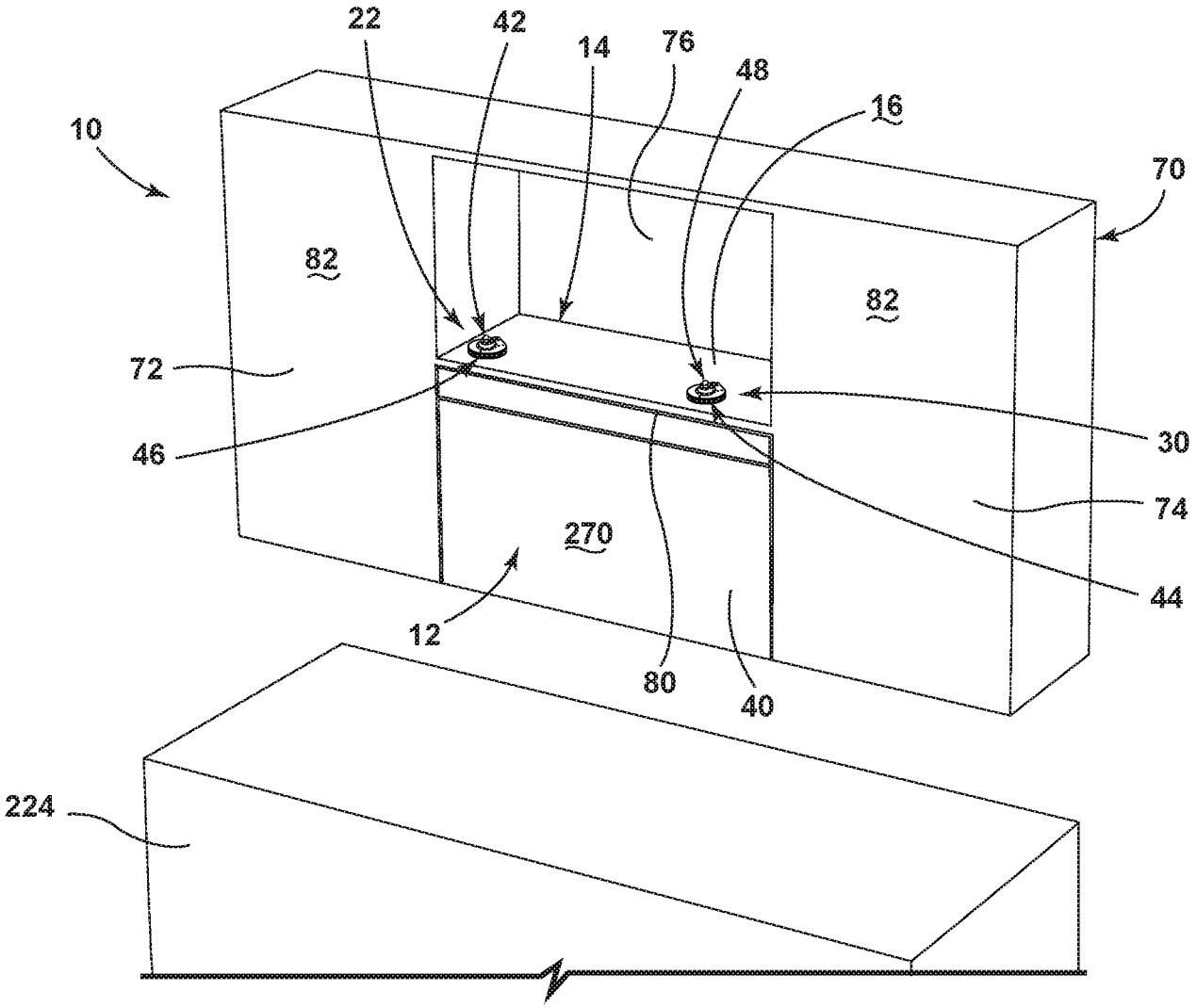
FIG. 1 is a front perspective view of a cooking appliance retained in a hanging position via an installation system, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to an installation system for a cooking appliance and a method for installing a cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With reference to FIGS. 1-20, reference numeral 10 generally designates an installation system 10 for a cooking appliance 12, such as a microwave oven, which includes a support structure 14 having an upper surface 16 and a lower surface 18. The support structure 14 defines at least one aperture 20. At least one retaining assembly 22 coupled to the upper surface 16 of the support structure 14. The retaining assembly 22 defines a channel 24 configured to align with the aperture 20. The cooking appliance 12 has a top surface 26 and a bottom surface 28. At least one coupling assembly 30 is coupled to the top surface 26 of the cooking appliance 12. The coupling assembly 30 is disposed within the channel 24 and retained in position by the retaining assembly 22 to install the cooking appliance 12 to the support structure 14 proximate to the lower surface 18.

Figure 2:
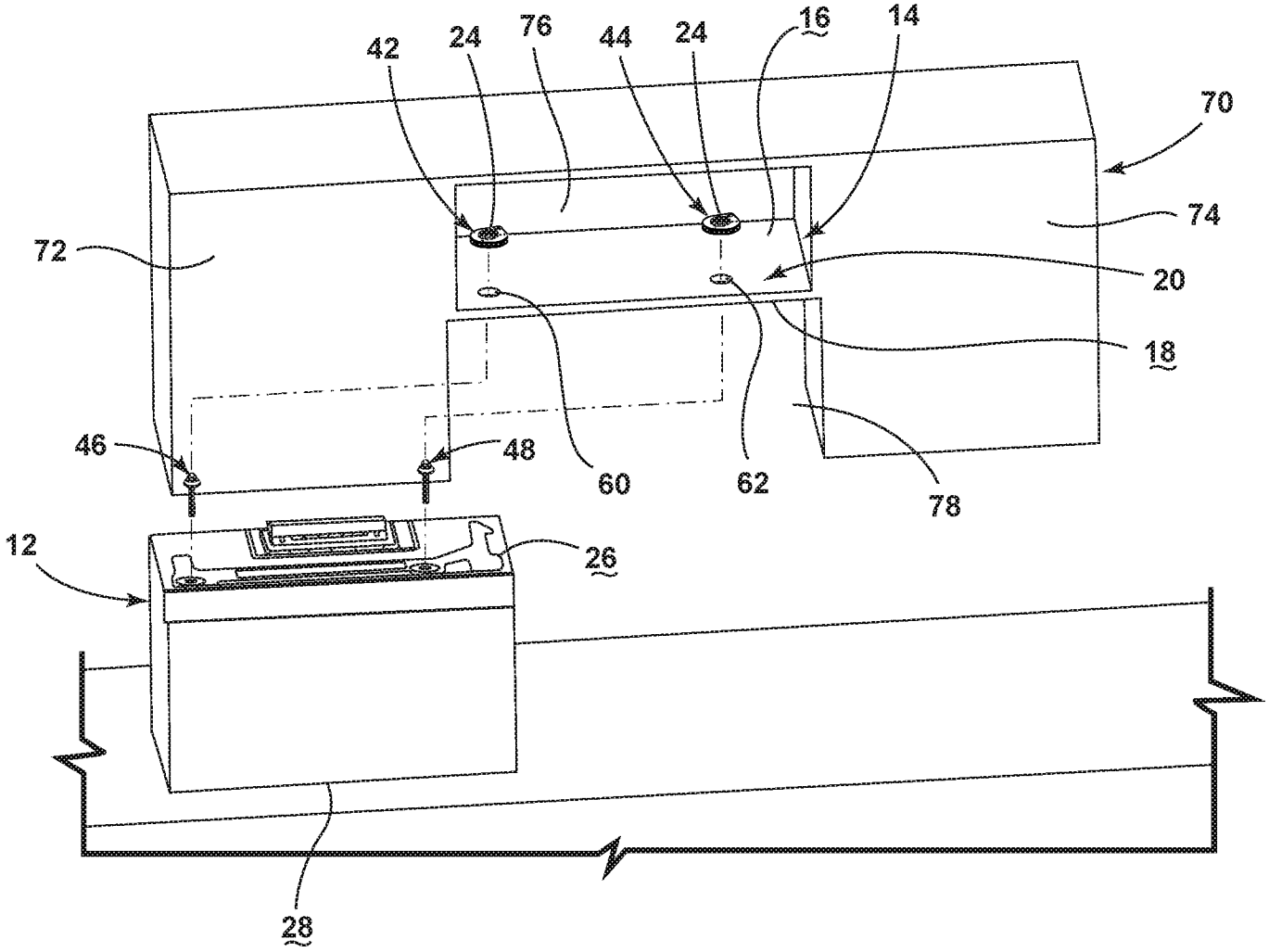
FIG. 2 is an exploded view of an installation system for installing a cooking appliance in a hanging position, according to the present disclosure.

Referring to FIGS. 1 and 2, the installation system 10 retains and secures the cooking appliance 12 in an installed or hanging position 40. The cooking appliance 12 is illustrated as a microwave oven. The cooking appliance 12 may be a microwave oven, a microwave-hood combination, other cooking appliance, or other hanging appliance without departing from the teachings herein.

The at least one retaining assembly 22 of the installation system 10 generally includes a first retaining assembly 42 and a second retaining assembly 44. The first retaining assembly 42 is horizontally aligned with and spaced from the second retaining assembly 44. Additionally, the at least one coupling assembly 30 includes a first coupling assembly 46 and a second coupling assembly 48. The first coupling assembly 46 is configured to engage the first retaining assembly 42, while the second coupling assembly 48 is configured to engage the second retaining assembly 44. The configuration of the retaining assemblies 42, 44 and the coupling assemblies 46, 48 supports opposing sides (e.g., right and left sides) of the cooking appliance 12.

The support structure 14 is a horizontal support feature that defines the at least one aperture 20, which extends from the upper surface 16 to the lower surface 18. The at least one aperture 20 includes a first aperture 60 spaced from a second aperture 62. The first and second apertures 60, 62 are generally horizontally aligned.

In the illustrated example of FIGS. 1 and 2, the support structure 14 is part of a storage assembly 70, such as cabinetry. The storage assembly 70 includes first and second cabinets 72, 74 with the support structure 14 extending therebetween. An upper cavity 76 is defined above the support structure 14 and between the first and second cabinets 72, 74. The upper cavity 76 may be storage space within the storage assembly 70 and may be enclosable by doors. A lower cavity 78 is defined below the support structure 14 and between the first and second cabinets 72, 74. Generally, a front edge 80 of the support structure 14 aligns with a front surface 82 of each of the first cabinet 72 and the second cabinet 74 to form a continuous front of the storage assembly 70. It is contemplated that the storage assembly 70 may have any practicable configuration having the support structure 14 without departing from the teachings herein. Further, it is also contemplated that the support structure 14 may be a standalone feature that is not included with the storage assembly 70 or other assemblies.

Referring still to FIGS. 1 and 2, the first and second retaining assemblies 42, 44 are coupled to the upper surface 16 of the support structure 14 within the upper cavity 76. The first retaining assembly 42 is positioned to align the channel 24 defined therein with the first aperture 60. The second retaining assembly 44 is positioned to align the channel 24 defined therein with the second aperture 62. The positioning of the first and second apertures 60, 62 relative to the front edge 80 of the support structure 14 and the first and second cabinets 72, 74 may depend on the configuration of the cooking appliance 12 to be supported. In the example illustrated in FIG. 2, the first and second apertures 60, 62 spaced a substantially similar distance from the front edge 80 of the support structure 14 and are arranged in an off-center or non-symmetrical configuration relative to a center of the storage assembly 70.

Figure 3:
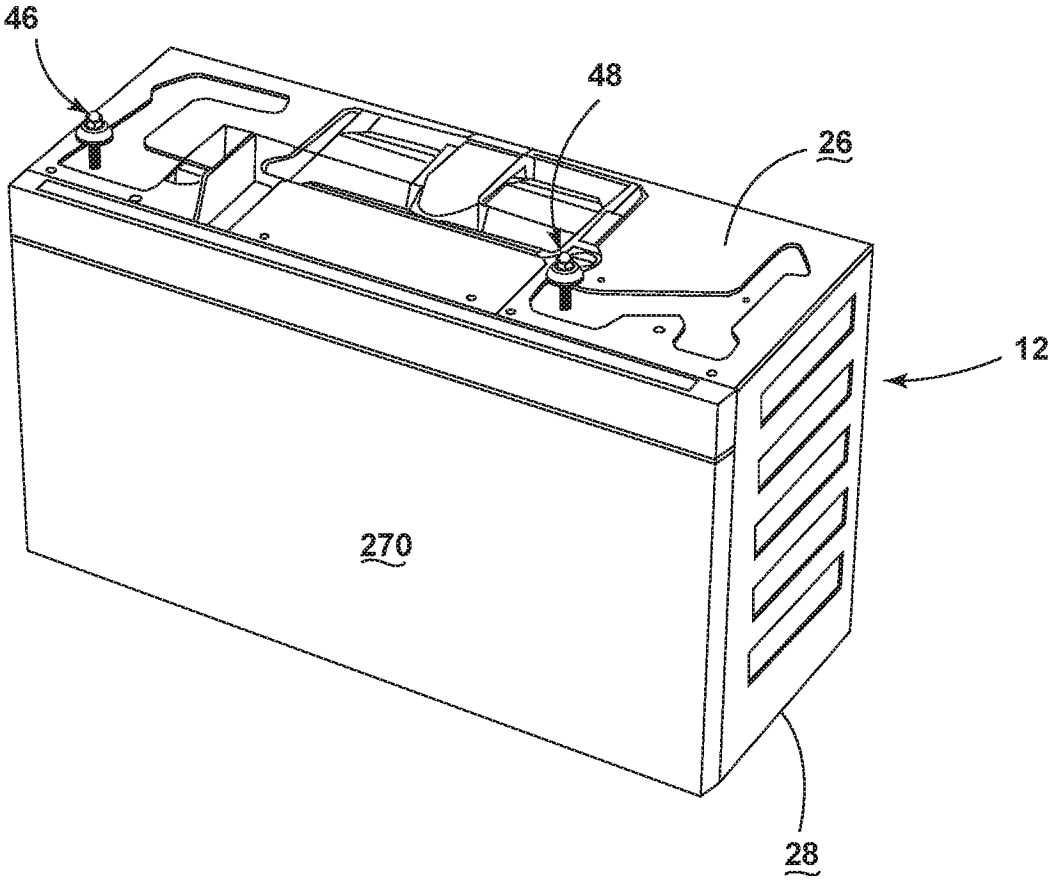
FIG. 3 is a top perspective view of a cooking appliance having coupling assemblies coupled to a top surface thereof, according to the present disclosure.

Referring to FIG. 3, the first and second coupling assemblies 46, 48 are coupled to the top surface 26 of the cooking appliance 12. The cooking appliance 12 defines receiving openings to receive and hold the coupling assemblies 46, 48. The engagement between the coupling assemblies 46, 48 and the cooking appliance 12 is sufficiently secure to support the cooking appliance 12 in the hanging position 40. The positioning of the coupling assemblies 46, 48 on the top surface 26 may depend on the configuration of interior components of the cooking appliance 12, as well as to provide support across the cooking appliance 12. The first and second coupling assemblies 46, 48 are configured to be coupled to the top surface 26 of the cooking appliance 12 prior to the engagement with the retaining assemblies 42, 44.

Figure 4:
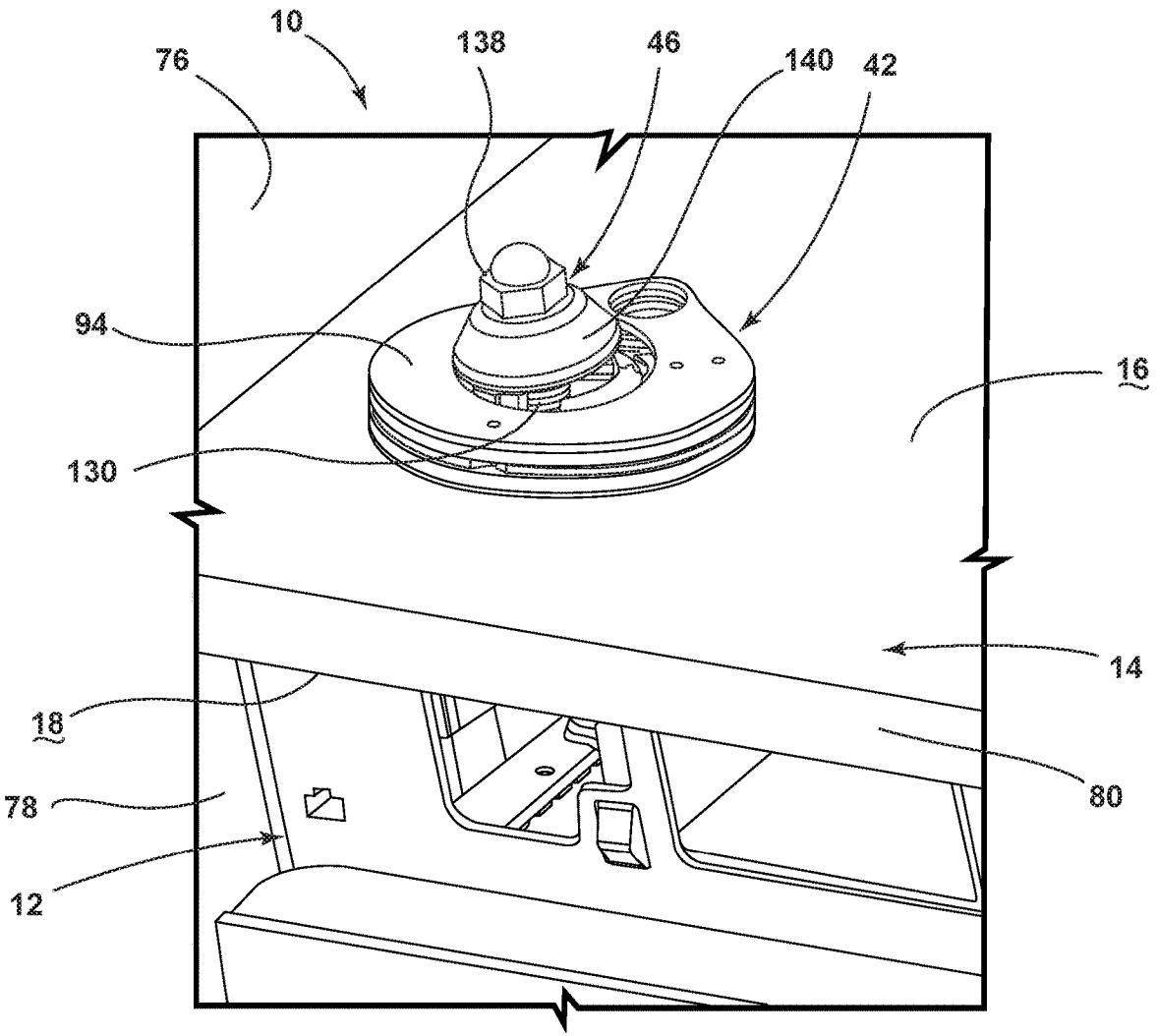
FIG. 4 is an enlarged top perspective view of a coupling assembly of an installation system engaging a retaining assembly on a support structure, according to the present disclosure.
Figure 5:
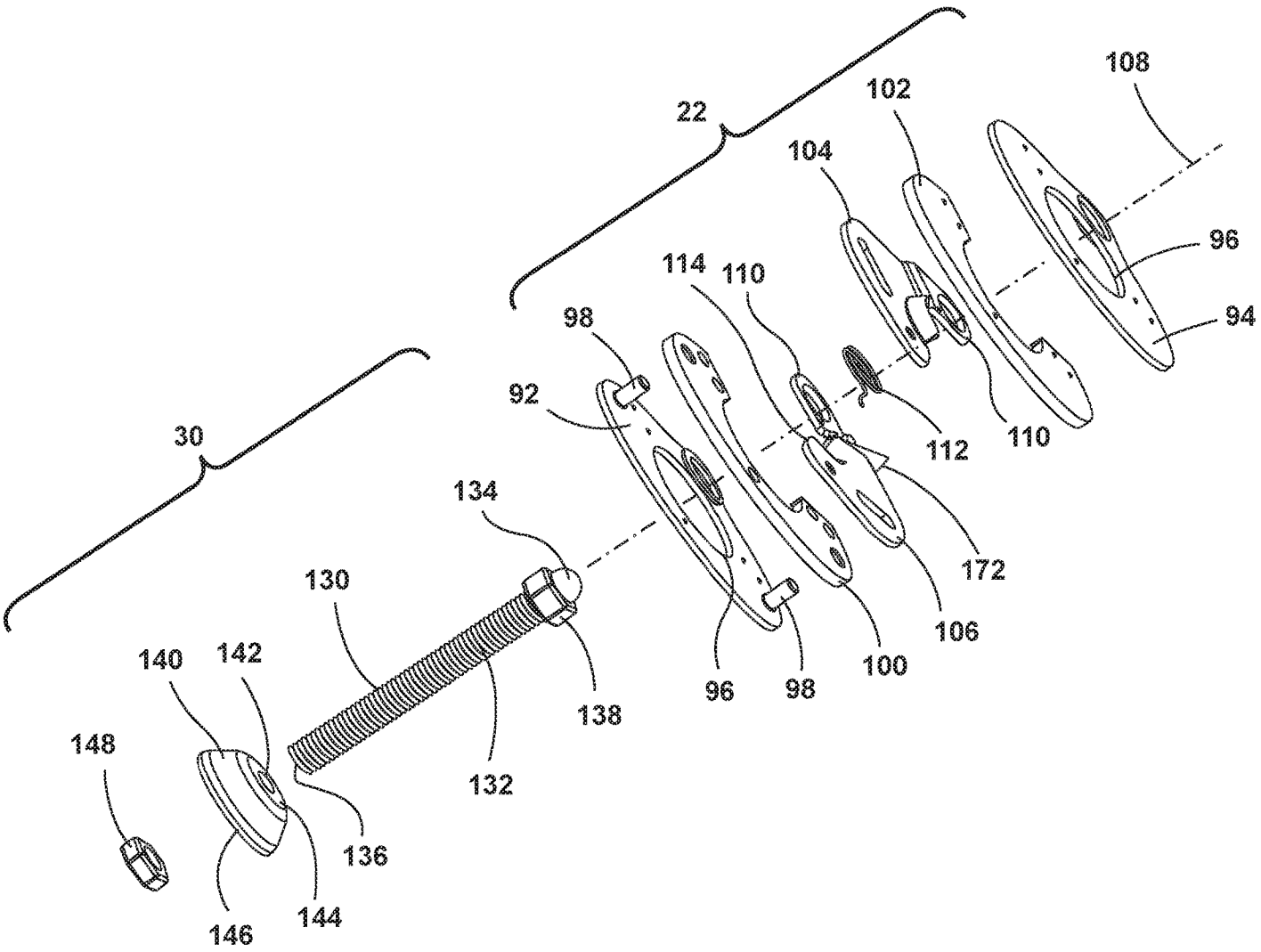
FIG. 5 is an exploded view of a coupling assembly and a retaining assembly of an appliance installation system, according to the present disclosure.
Figure 7:
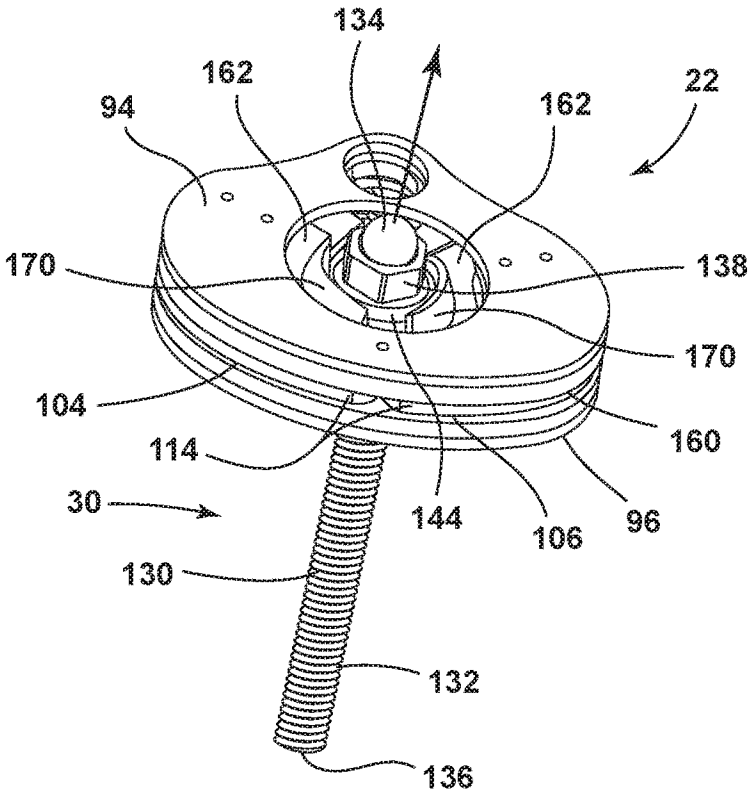
FIG. 7 is a side perspective view of a coupling assembly positioned to be inserted through a retaining assembly in an installation system, according to the present disclosure.
Figure 6:
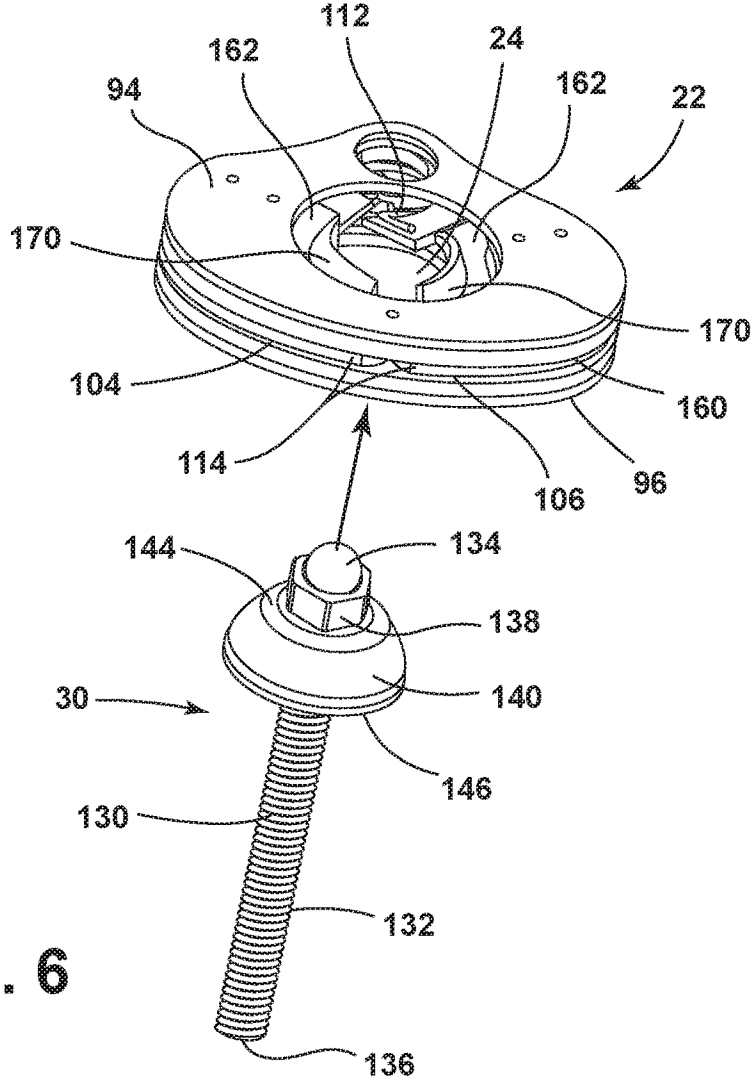
FIG. 6 is a side perspective view of a coupling assembly positioned to be inserted into a channel of a retaining assembly in an installation system, according to the present disclosure.
Figure 9:
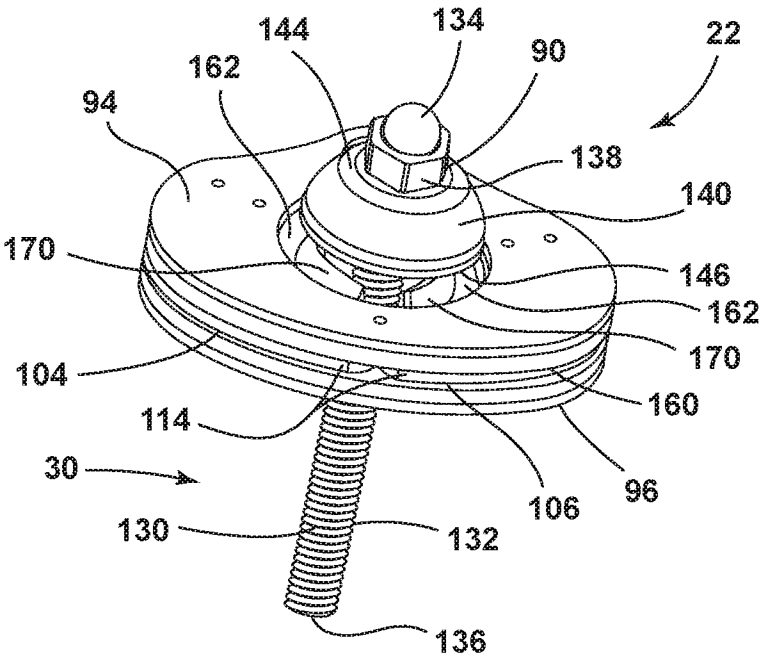
FIG. 9 is a side perspective view of a coupling assembly in an installed position in a retaining assembly for an installation system, according to the present disclosure.

Referring to FIGS. 4 and 5, the first retaining assembly 42 and the first coupling assembly 46 are illustrated in more detail. It is contemplated that any description relating to the first retaining assembly 42 and the first coupling assembly 46 is also applicable to the second retaining assembly 44 and the second coupling assembly 48, respectively. The first retaining assembly 42 defines the channel 24, which extends in a vertical orientation. The first coupling assembly 46 is configured to be retained in the first retaining assembly 42 within the channel 24 in an installed position 90. As best illustrated in FIG. 4, when the first coupling assembly 46 is in the installed position 90, the first coupling assembly 46 extends from the top surface 26 of the cooking appliance 12 below the support structure 14, through the first aperture 60 defined in the support structure 14, and through the channel 24 defined by the first retaining assembly 42. This positioning secures the cooking appliance 12 in the hanging position 40 abutting the lower surface 18 of the support structure 14.

The first retaining assembly 42 includes a lower cover 92 coupled to the upper surface 16 of the support structure 14. The first retaining assembly 42 also includes an upper cover 94 spaced from and vertically aligned with the lower cover 92. The lower cover 92 and the upper cover 94 have a substantially similar shape. Additionally, each of the lower cover 92 and the upper cover 94 define openings 96 that at least partially define the channel 24. The lower cover 92 includes pins 98 extending toward the upper cover 94. The pins 98 retain the spacing within the first retaining assembly 42, as well as provide support for the components of the first retaining assembly 42.

Referring still to FIGS. 4 and 5, the first retaining assembly 42 also includes a lower bracket 100 coupled to the lower cover 92 and an upper bracket 102 coupled to the upper cover 94. The covers 92, 94 and the brackets 100, 102 are arranged in a stacked configuration. The lower bracket 100 and upper bracket 102 are positioned within the space defined between the lower cover 92 and the upper cover 94. The pins 98 may extend through the lower bracket 100 to assist in retaining the alignment between the lower bracket 100 and the lower cover 92. Each of the lower bracket 100 and upper bracket 102 has a generally U-shaped configuration to at least partially define the channel 24. Further, the brackets 100, 102 may not extend beyond outer edges or inner edges of the covers 92, 94.

The first retaining assembly 42 also includes a first side arm 104 and a second side arm 106, which are positioned between the lower bracket 100 and upper bracket 102. The side arms 104, 106 are configured to rotate about a pivot point or axis 108. The axis 108 generally aligns with the opening portion of the U-shaped brackets 100, 102. Each of the side arms 104, 106 are coupled at a proximal end 110 to a biasing member 112. The biasing member 112 is illustrated as a spring, but any practicable configuration of the biasing member 112 may be utilized in the installation system 10. The proximal ends 110 of the side arms 104, 106 may be in a stacked configuration with one another, while distal ends 114 may be arranged in a generally coplanar or side-by-side configuration.

The first retaining assembly 42 forms a stacked structure, which supports the side arms 104, 106 in the center thereof. The side arms 104, 106 are curved to follow the shape of the covers 92, 94 and the brackets 100, 102 to at least partially define the channel 24. Each component of the first retaining assembly 42 is generally flat to form a compact retaining assembly 42.

With further reference to FIGS. 4 and 5, the first coupling assembly 46 includes an elongated coupling feature 130, such as, for example, a pin, a bolt, or a screw. The coupling feature 130 generally defines threads 132 along at least a portion of a length thereof. In addition, as illustrated in FIG. 5, the threads 132 extends along the entire length from an insertion end 134 to a coupling end 136. The insertion end 134 is configured to be inserted into the channel 24, while the coupling end 136 is configured to engage the cooking appliance 12.

A securing feature or nut 138 is disposed proximate to the insertion end 134. A retaining or locking feature 140 is positioned about the coupling feature 130. The locking feature 140 defines a central aperture 142 through which the coupling feature 130 extends. The locking feature 140 has a bell shape or frusto-conical shape, such that a first end 144 positioned adjacent to the nut 138 has a smaller width than a second end 146. The shape of the locking feature 140 is advantageous for inserting the coupling assembly 46 into the channel 24, as well as maintaining an engagement between the coupling assembly 46 and the retaining assembly 42, as described further herein.

An additional securing feature or nut 148 is coupled to the coupling feature 130 on the opposing side of the locking feature 140 relative to the nut 138. The nuts 138, 148 are configured to engage the threads 132 and secure the locking feature 140 in a select position relative to the coupling feature 130.

Referring now to FIG. 5, as well as to FIGS. 6-9, the coupling assembly 30 is configured to be inserted into and retained in the installed position 90 by the retaining assembly 22. It is contemplated that description relating to the coupling assembly 30 is applicable to each of the first and second coupling assemblies 46, 48, and that the description relating to the retaining assembly 22 is applicable to each of the first and second retaining assemblies 42, 44. The insertion and engagement between the coupling assembly 30 and the retaining assembly 22 increase the convenience of an installation process and supports the cooking appliance 12 in the installed hanging position 40 (FIG. 1).

Prior to the engagement with the coupling assembly 30, the side arms 104, 106 of the retaining assembly 22 are in a retracted position 160. The biasing member 112 biases the side arms 104, 106 in the retracted position 160 where the distal ends 114 of the side arms 104, 106 are disposed adjacent to one another. When in the retracted position 160, the side arms 104, 106 may not extend past the outer edges of the covers 92, 94. The side arms 104, 106 may extend beyond the inner edges of the covers 92, 94 and partially into the channel 24.

Figure 8:
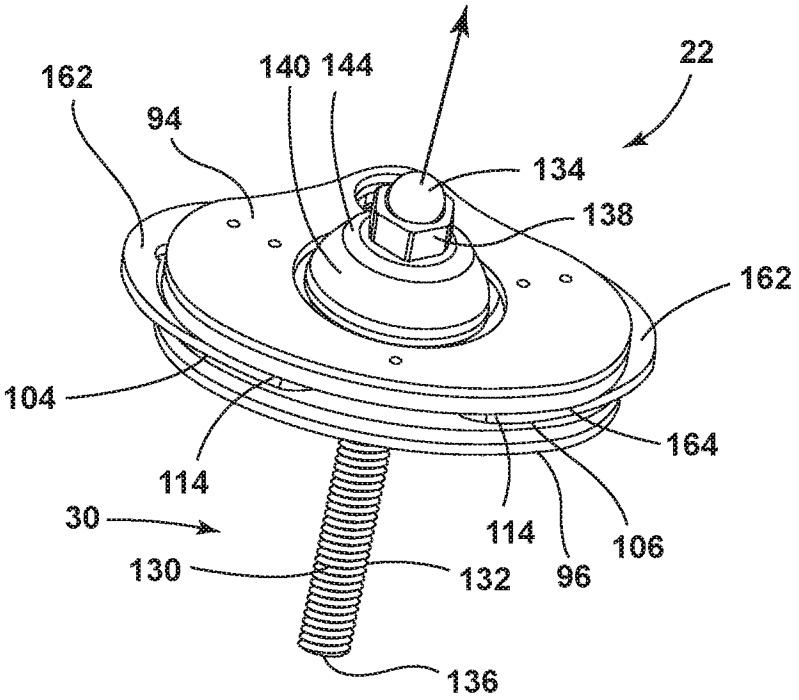
FIG. 8 is a side perspective view of a coupling assembly positioned in a channel of a retaining assembly and adjusting side arms to an extended position, according to the present disclosure.

The coupling assembly 30 is moved into the channel 24 from proximate to the lower cover 92, such that the coupling assembly 30 is inserted or pushed vertically up through the retaining assembly 22. As the locking feature 140 moves through the channel 24, the locking feature 140 is configured to engage inner edges 162 of the side arms 104, 106 that are disposed within the channel 24. As the coupling assembly 30 is pushed further through the channel 24, the increasing width of the locking feature 140 causes the side arms 104, 106 to adjust outward, against a biasing force, and away from one another to an extended position 164, as best illustrated in FIG. 8. When in the extended position 164, the distal ends 114 of the side arms 104, 106 are spaced from one another and the side arms 104, 106 extend at least partially beyond the outer edges of the covers 92, 94. The movement of the coupling assembly 30 causes the side arms 104, 106 to move against the biasing force of the biasing member 112 into the extended position 164.

Once the locking feature 140 is moved past the side arms 104, 106, the biasing force of the biasing member 112 adjusts the inner edges 162 of the side arms 104, 106 back to the retracted position 160. After returning to the retracted position 160, the inner edges 162 of the side arms 104, 106 are again positioned partially within the channel 24. The inner edges 162 each define a ridge or lip 170 that extends toward the upper cover 94. The lips 170 are positioned within the channel 24 on opposing sides of the coupling feature 130. A distance between the lips 170 is generally equal to or less than the width of the second end 146 of the locking feature 140. In this way, the locking feature 140 is positioned on and retained in position by the lips 170, which prevents the coupling assembly 30 from disengaging from the retaining assembly 22.

Referring still to FIGS. 5-9, the engagement between the coupling assembly 30 and the retaining assembly 22 is maintained until released by a user. At least one of the side arms 104, 106 includes a release tab 172, which extends beyond the outer edges of the covers 92, 94. In the illustrated example, the release tab 172 extends from the side arm 106. The release tab 172 is configured to adjust the side arm 106 to the extended position 164. When the side arm 106 is adjusted to the extended position 164, the channel 24 is widened, allowing the locking feature 140 to disengage from the lips 170 and the coupling assembly 30 to move through the channel 24. It is contemplated that both of the side arms 104, 106 may include release tabs 172, allowing the user to manually adjust both side arms 104, 106 to the extended position 164.

Figure 10:
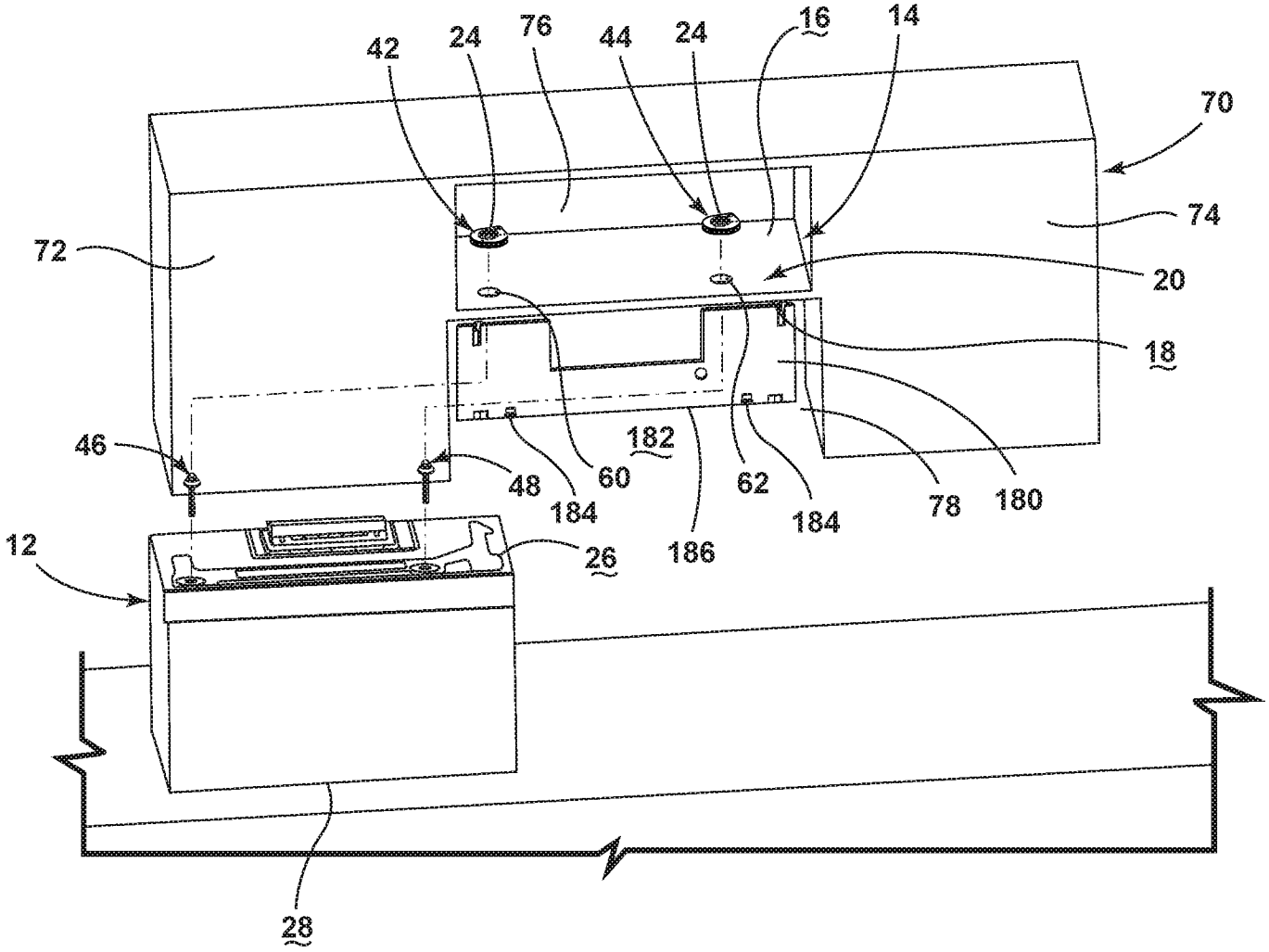
FIG. 10 is an exploded view of an installation system having a back plate and for installing a cooking appliance in a hanging position, according to the present disclosure.
Figure 11:
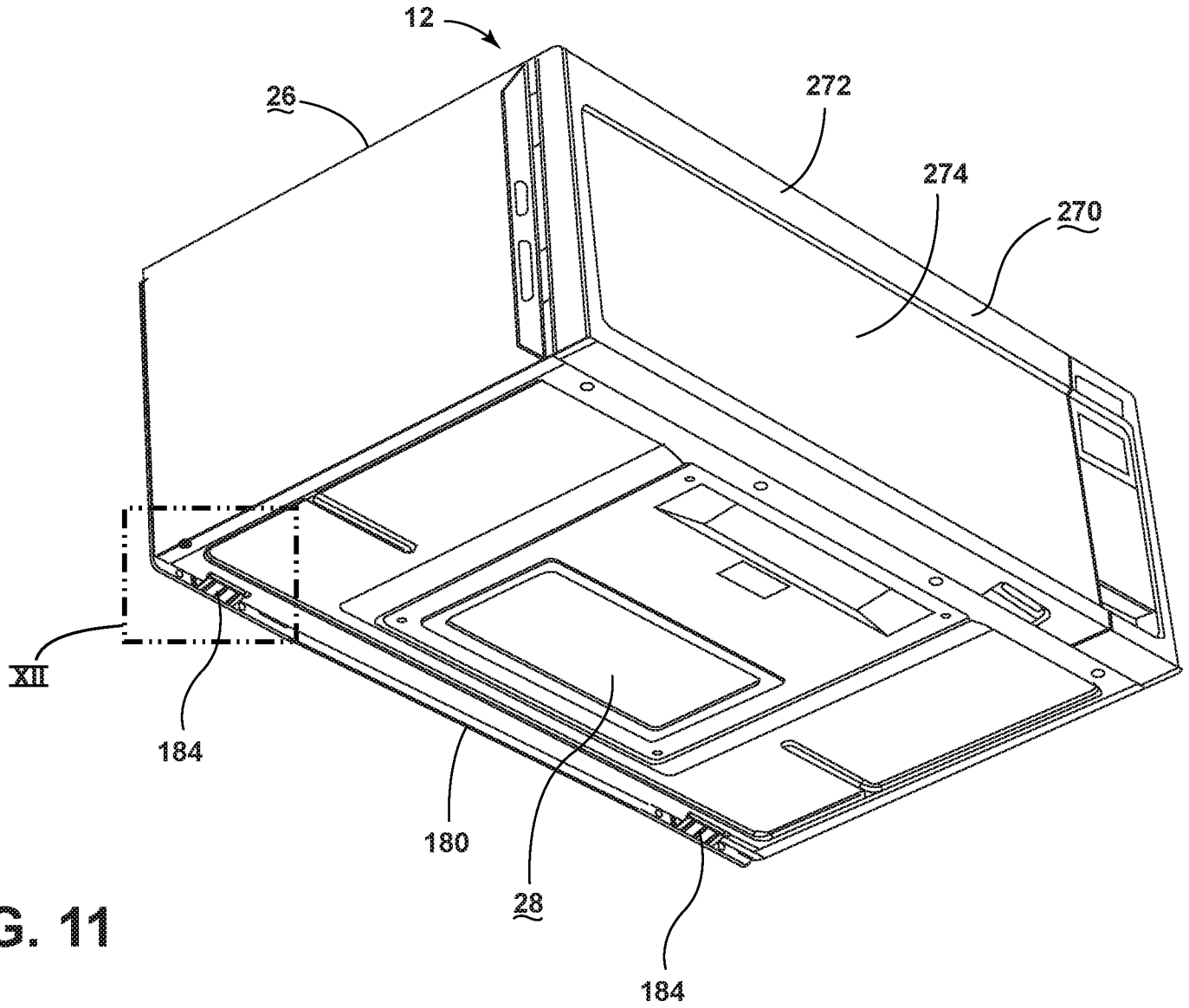
FIG. 11 is a bottom perspective view of hooks on a back plate engaging a bottom surface of a cooking appliance, according to the present disclosure.
Figure 12:
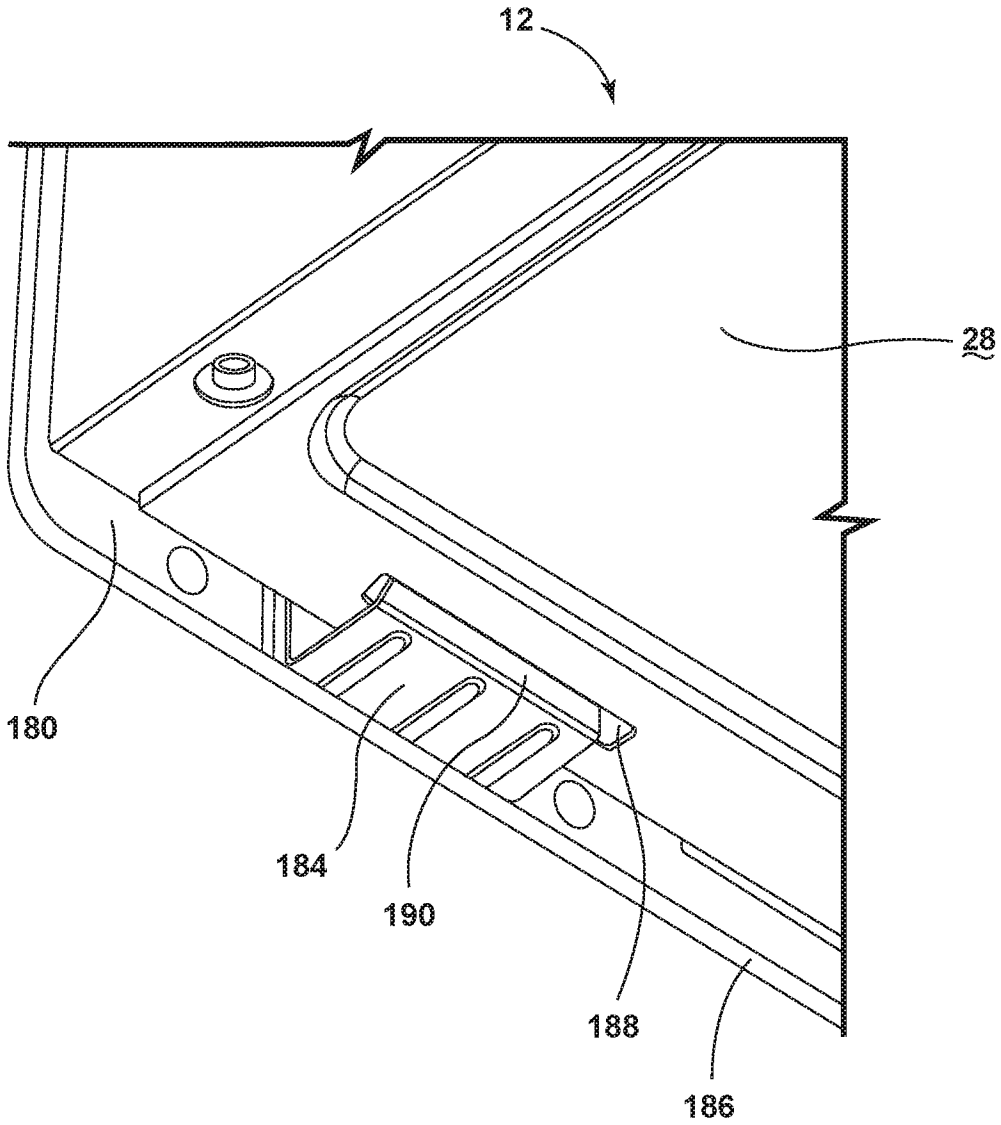
FIG. 12 is a partial enlarged view of a hook engaging the bottom surface of the cooking appliance in FIG. 11, taken at area XII, according to the present disclosure.

Referring to FIGS. 10-12, in addition to the engagement between the retaining assemblies 42, 44 and the coupling assemblies 46, 48, the cooking appliance 12 may be supported by a back plate 180 coupled to a rear surface 182. In the illustrated configuration of FIG. 10, the rear surface 182 is a wall surface within the lower cavity 78; however, the rear surface 182 may also be a surface of the storage assembly 70 without departing the teachings herein. The back plate 180 is positioned proximate to the lower surface 18 of the support structure 14 between the first and second cabinets 72, 74. The back plate 180 may be fastened or otherwise secured to the rear surface 182 to provide additional support for the cooking appliance 12 when in the hanging position 40.

The back plate 180 generally includes hooks 184 proximate to a bottom edge 186 thereof. In the example illustrated in FIGS. 9 and 10, the back plate 180 includes two hooks 184 spaced from one another. The back plate 180 may have any practicable number of hooks 184 for supporting the cooking appliance 12, which may not be limited to the bottom edge 186 of the back plate 180.

The hooks 184 engage the bottom surface 28 of the cooking appliance 12 to provide a ledge for the cooking appliance 12 to at least partially rest on. When using the back plate 180, the cooking appliance 12 is supported from above by the support structure 14 with the coupling assemblies 46, 48 engaging the retaining assemblies 42, 44 and from below by the hooks 184 on the back plate 180.

As best illustrated in FIG. 11, the bottom surface 28 of the cooking appliance 12 defines a slot 188 that corresponds with each hook 184. In such examples, each hook 184 includes a distal engagement feature 190 that engages the respective slot 188. As illustrated, the engagement feature 190 is an angled projection that extends into the slot 188. The engagement with the slot 188 provides additional security, additional support, and additional assistance in properly positioning the cooking appliance 12.

Figure 13:
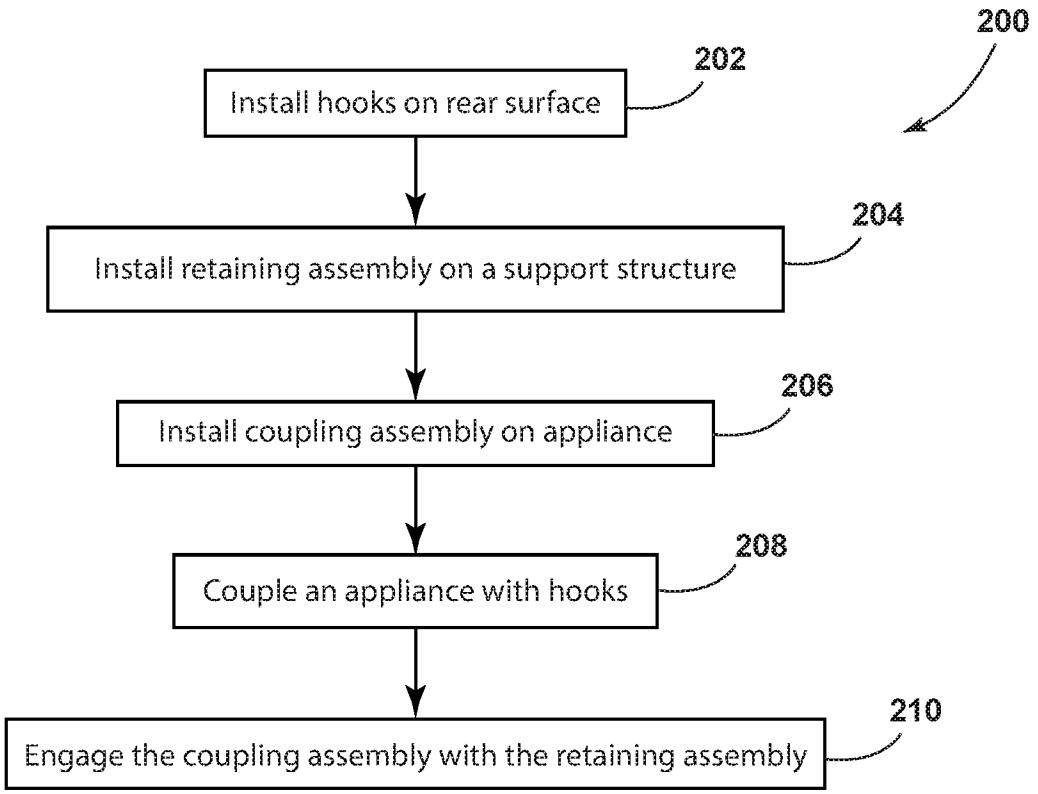
FIG. 13 is a flow diagram of a method of installing a cooking appliance in a hanging position, according to the present disclosure.

Referring now to FIG. 13, as well as to FIGS. 1-12, a method 200 of installing the cooking appliance 12 includes step 202 of installing the back plate 180 on the rear surface 182. The back plate 180 is fastened or otherwise secured to the rear surface 182 proximate to the lower surface 18 of the support structure 14. Further, in step 202, holes may be drilled in the rear surface 182 within the lower cavity 78 to receive fasteners for coupling the hooks 184 and/or the back plate 180. The hooks 184 are horizontally aligned with one another to provide a uniform lower support for the cooking appliance 12.

In step 204, the retaining assemblies 42, 44 are coupled to the upper surface 16 of the support structure 14. The retaining assemblies 42, 44 may be fastened, adhered, or otherwise secured to the support structure 14. The channels 24 of the retaining assemblies 42, 44 are aligned with the apertures 60, 62 defined in the support structure 14. In various aspects, step 204 may also include forming the apertures 60, 62 in the support structure 14. The position of the apertures 60, 62 is configured to match the position of the coupling assemblies 46, 48.

In step 206, the coupling assemblies 46, 48 are coupled with the top surface 26 of the cooking appliance 12. In certain aspects, the threads 132 may engage a mating structure of the cooking appliance 12 to secure the coupling assemblies 46, 48 thereto. In step 208, the cooking appliance 12 is lifted and moved into the lower cavity 78. The cooking appliance 12 is adjusted to engage the bottom surface 28 with the hooks 184. The engagement features 190 are positioned within the slots 188. The cooking appliance 12 may rest on the hooks 184. The hooks 184 engage the slots 188 to assist in supporting the cooking appliance 12 on the back plate 180 and/or the rear surface 182. Step 208 may also include aligning the cooking appliance 12 relative to the storage assembly 70.

In step 210, the locking features 140 of the coupling assemblies 46, 48 engage the retaining assemblies 42, 44 and retain the cooking appliance 12 in the hanging position 40. The coupling assemblies 46, 48 are aligned with the apertures 60, 62 proximate to the lower surface 18 of the support structure 14. The coupling assemblies 46, 48 are then inserted through the apertures 60, 62 and the retaining assemblies 42, 44. As the cooking appliance 12 is lifted closer to the support structure 14, the coupling assemblies 46, 48 travel further through the retaining assemblies 42, 44, causing the side arms 104, 106 to move to the extended position 164. The coupling assemblies 46, 48 may be moved through the retaining assemblies 42, 44 until the side arms 104, 106 are returned to the retracted position 160. The cooking appliance 12 is supported in two different locations (e.g., top and bottom). It is understood that the steps of the method 200 may be performed in any order, simultaneously, and/or omitted without departing from the teachings provided herein.

Figure 14:
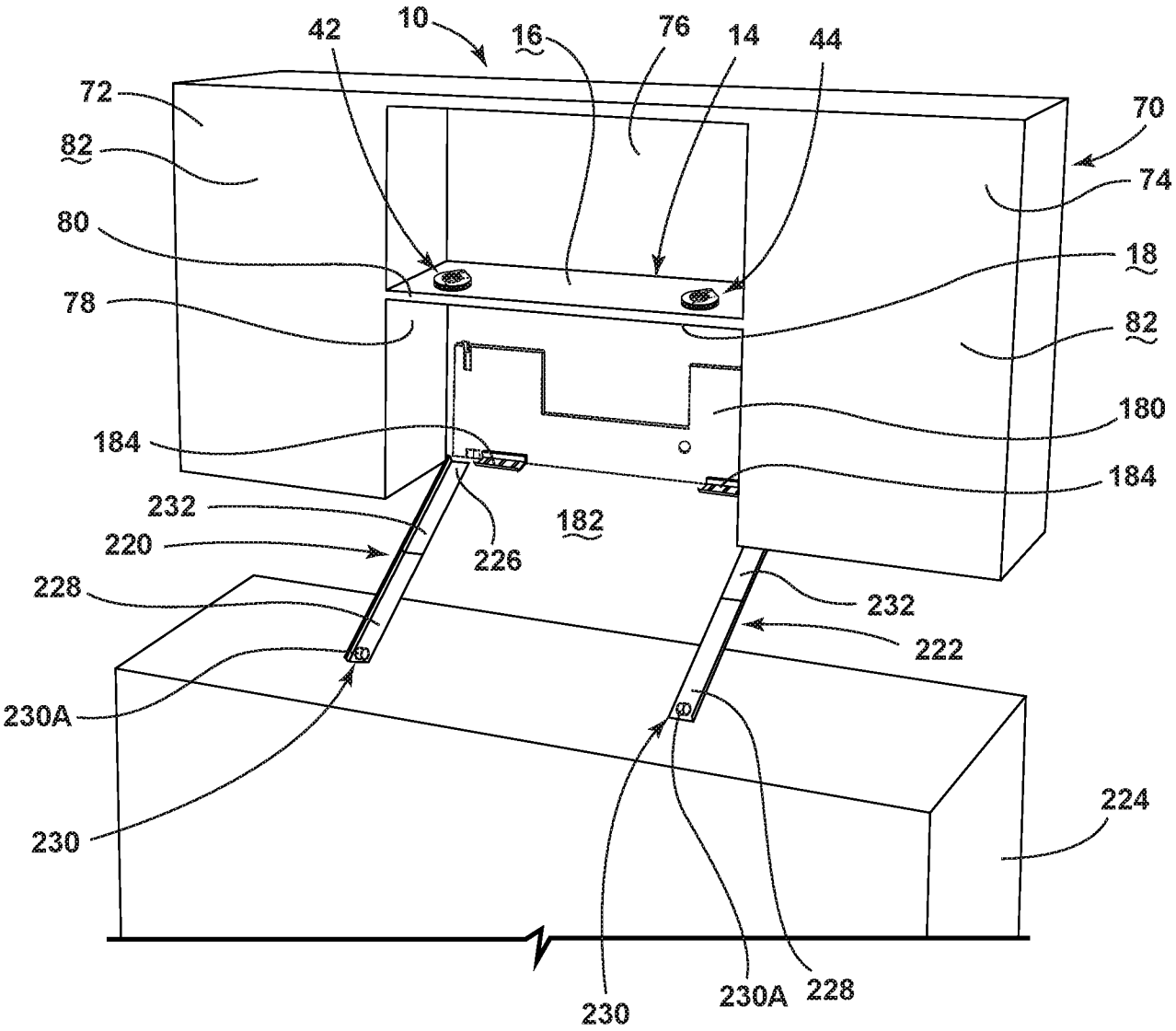
FIG. 14 is a front perspective view of an appliance installation system having a back plate with hooks, retaining assemblies, and guide rails, according to the present disclosure.
Figure 15:
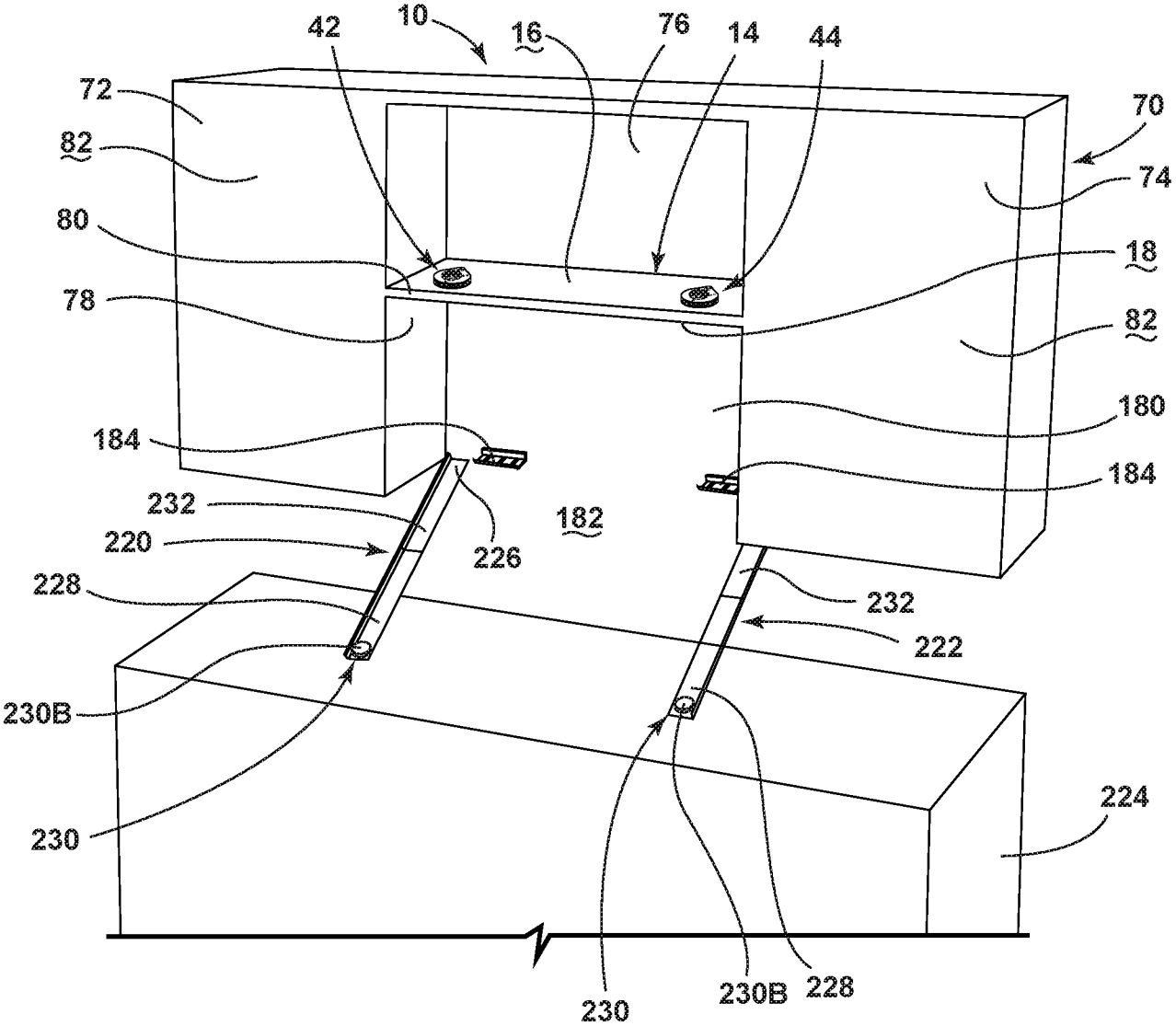
FIG. 15 is a front perspective view of an appliance installation system having hooks, retaining assemblies, and guide rails, according to the present disclosure.

Referring to FIGS. 14 and 15, the installation system 10 may include guide rails 220, 222 to assist in lifting or moving the cooking appliance 12 toward the support structure 14. The guide rails 220, 222 generally extend between the lower cavity 78 and a lower support feature 224. The lower support feature 224 may be in a countertop, an appliance, a storage assembly, cabinetry, or other similar features.

In various examples, rear ends 226 of the guide rails 220, 222 are positioned proximate to the back plate 180 or the rear surface 182, while front ends 228 rest on the lower support feature 224. The front ends 228 may include a stop feature that provides increased friction with the lower support feature 224 to assist in maintaining the front ends 228 stationary. The rear ends 226 may abut the rear surface 182, the back plate 180, the hooks 184, the cabinets 72, 74, or a combination thereof. In certain aspects, the rear ends 226 may be rotatably coupled with the rear surface 182, the back plate 180, or the hooks 184 to provide more secure positioning of the guide rails 220, 222 and support for the cooking appliance 12.

Each of the guide rails 220, 222 includes a guiding feature 230 that assists in moving the cooking appliance 12 along the guide rails 220, 222. In the example illustrated in FIG. 14, the guiding features 230 are configured as wheels 230A. In the example illustrated in FIG. 15, the guiding features 230 are configured as glides 230B. The guiding features 230 may be coupled with the guide rails 220, 222, respectively, such that the guiding features 230 may not disengage from the respective guide rail 220, 222 while the cooking appliance 12 is supported thereon. The guiding features 230 are configured to move between the rear ends 226 and the front ends 228.

Referring to FIG. 15, the hooks 184 may not be part of the back plate 180 but may be independent features. In the illustrated configuration of FIG. 15, the hooks 184 are coupled directly to the rear surface 182 between the cabinets 72, 74 within the lower cavity 78. The guide rails 220, 222 extend so the rear ends 226 are positioned proximate to the hooks 184 and/or the cabinets 72, 74, respectively. In certain aspects, the rear ends 226 may also be rotatably coupled with the hooks 184 or the rear surface 182.

Figure 16:
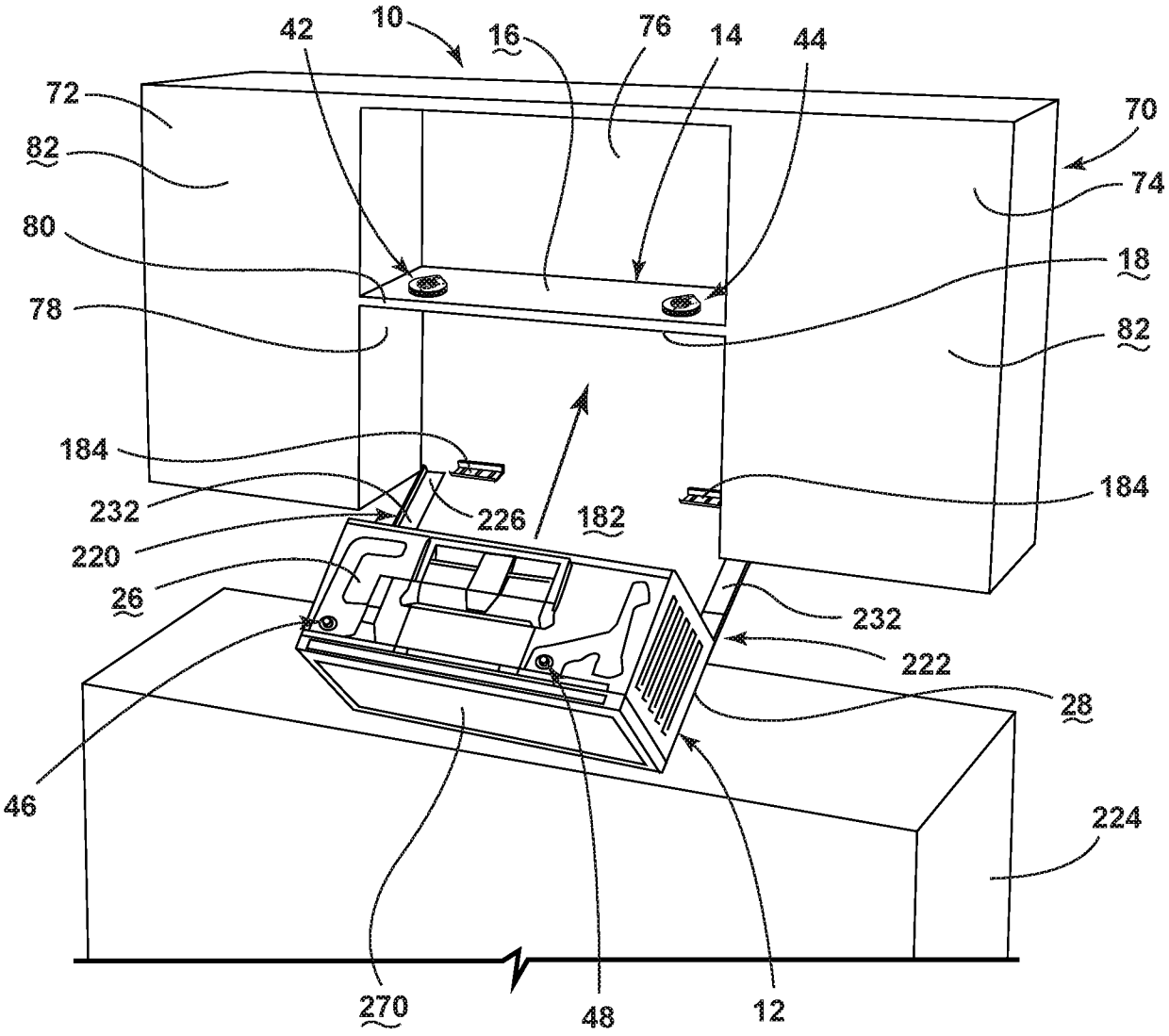
FIG. 16 is a front perspective view of a cooking appliance positioned on guide rails of an installation system adjacent to a lower support feature, according to the present disclosure.

Referring to FIGS. 16-19, the guide rails 220, 222 and the guiding features 230 assist in moving the cooking appliance 12 towards the support structure 14. The cooking appliance 12 having the coupling assemblies 46, 48 coupled thereto is positioned on the guide rails 220, 222 at the front ends 228, as best illustrated in FIG. 16.

Figure 17:
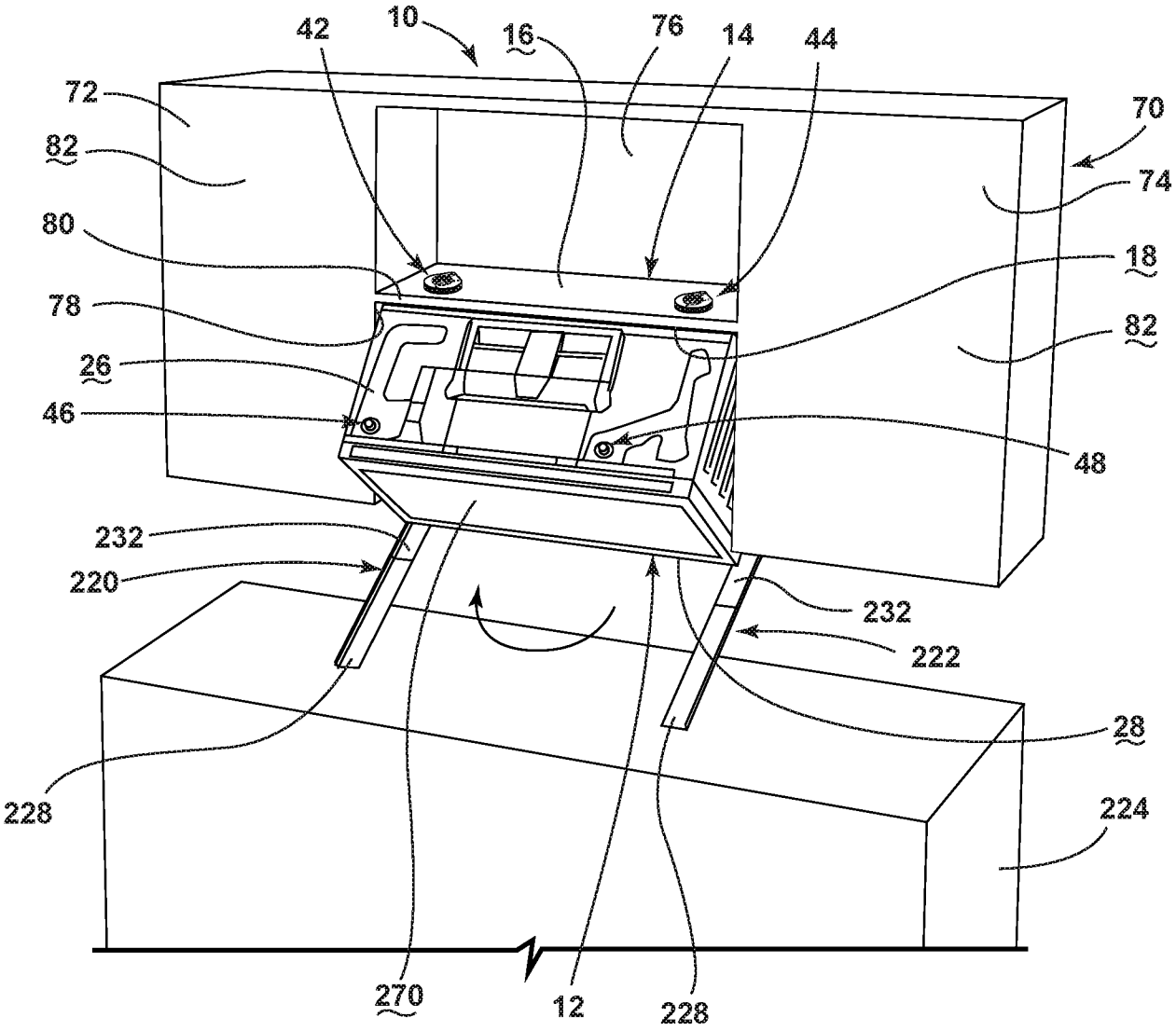
FIG. 17 is a front perspective view of a cooking appliance positioned on guide rails of an installation system adjacent to a storage assembly, according to the present disclosure.

The cooking appliance 12 is slid or pushed along the guide rails 220, 222 toward the rear ends 226 proximate the rear surface 182, as best illustrated in FIG. 17. In configurations having the guiding features 230, the guiding features 230 assist in sliding the cooking appliance 12 along the guide rails 220, 222. In examples without the guiding features 230, the bottom surface 28 of the cooking appliance 12 may slidably engage the guide rails 220, 222 as the cooking appliance 12 moves along the guide rails 220, 222. Once the cooking appliance 12 is positioned partially within the lower cavity 78, as illustrated in FIG. 17, the cooking appliance 12 is rotated further into the lower cavity 78, and the top surface 26 is moved adjacent to the lower surface 18 of the support structure 14 while the bottom surface 28 of the cooking appliance 12 is moved away from the guide rails 220, 222. The cooking appliance 12 is rotated and lifted slightly to push the coupling assemblies 46, 48 through the retaining assemblies 42, 44 coupled with the support structure 14. The bottom surface 28 engages the hooks 184 coupled to the rear surface 182 to fully position the cooking appliance 12 in the hanging position 40 as described herein.

Figure 18:
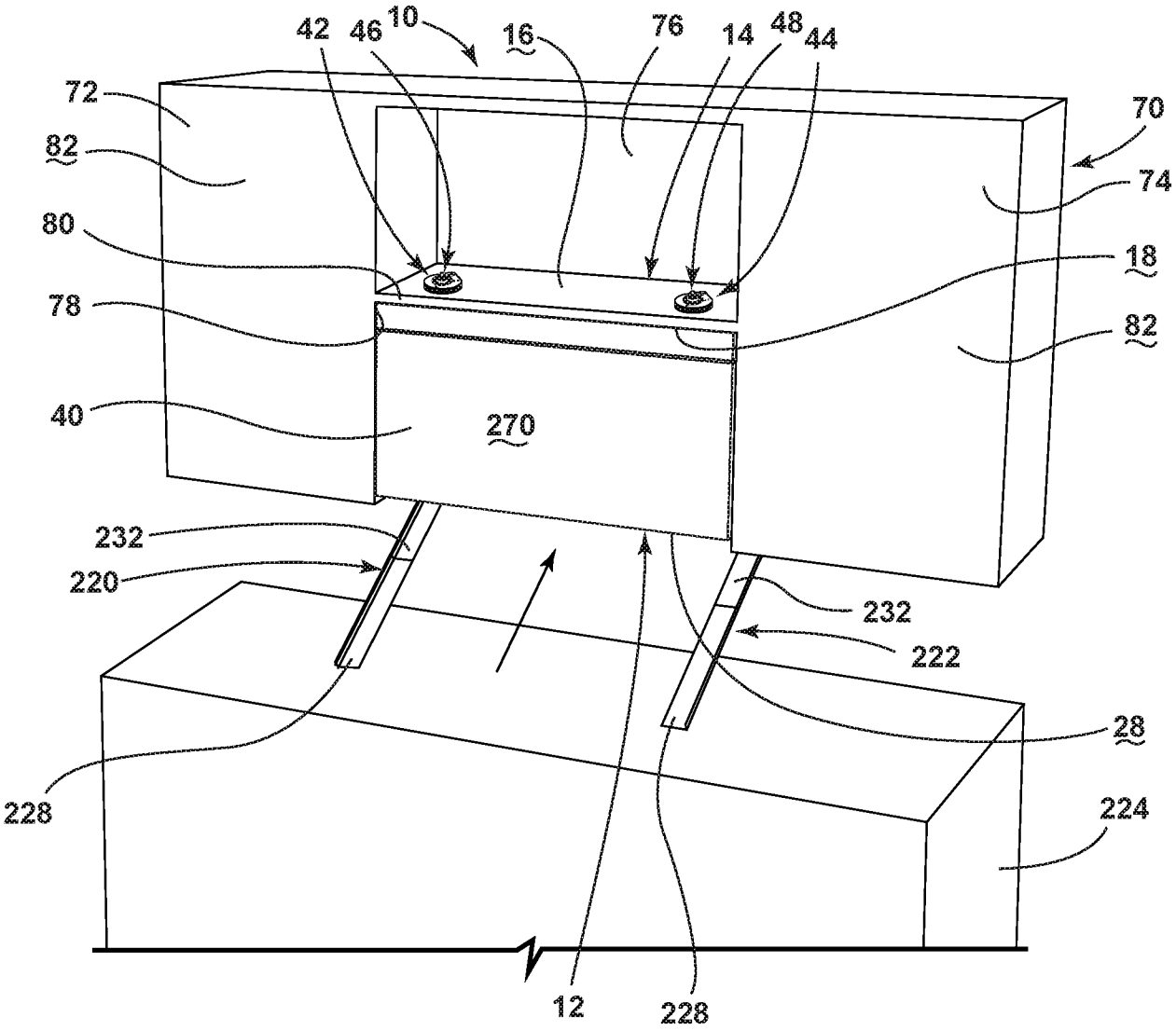
FIG. 18 is a front perspective view of a cooking appliance in a hanging position with guide rails of an installation system extending from the cooking appliance to a lower support feature, according to the present disclosure.

As illustrated in FIG. 18, when the cooking appliance 12 is in the hanging position 40, the guide rails 220, 222 may still extend between the rear surface 182 and the lower support feature 224. In various examples, the guide rails 220, 222 are telescoping rails. When used to support the cooking appliance 12, the guide rails 220, 222 are in extended positions 232. Once the cooking appliance 12 is supported in the hanging position 40 by the installation system 10, the guide rails 220, 222 may be adjusted into a retracted position 234. To move to the retracted position 234, the front ends 228 of the guide rails 220, 222 are shifted toward the cooking appliance 12. The retracted position 234 may be a stacked configuration between multiple segments, a nested position between multiple segments, or any other position that shortens the length of the guide rails 220, 222.

Figure 19:
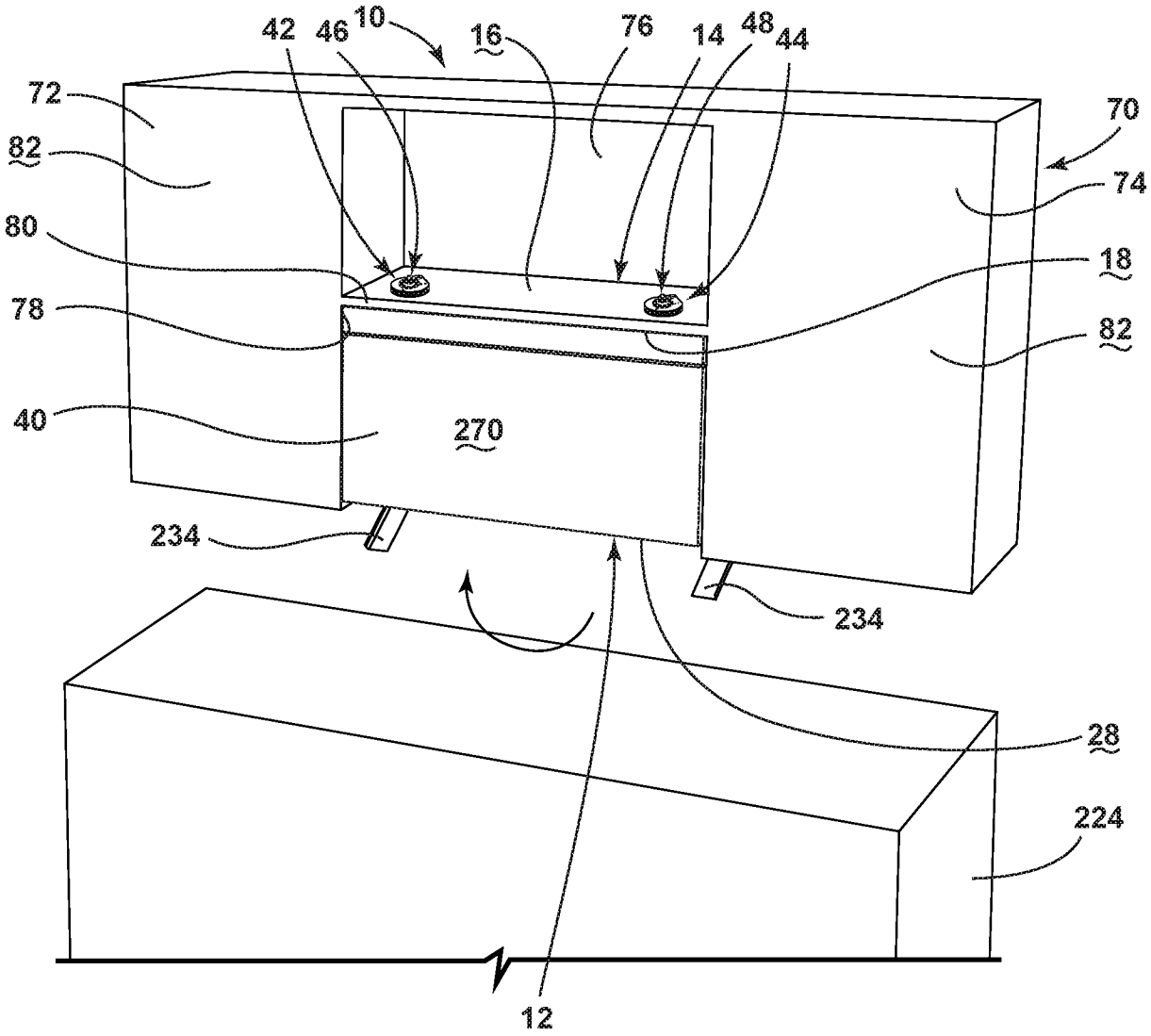
FIG. 19 is a front perspective view of a guide rail of an installation system being retracted and rotated to be coupled to a bottom surface of a cooking appliance, according to the present disclosure.

As best illustrated in FIG. 19, when the guide rails 220, 222 are in the retracted position 234, the length of the guide rails 220, 222 may be generally equal to or less than a depth of the cooking appliance 12. The guide rails 220, 222 may be rotated and selectively coupled to the bottom surface 28 of the cooking appliance 12. The guide rails 220, 222 may then be substantially obscured from view and stored with the cooking appliance 12 in the hanging position 40. The guiding features 230 may also be coupled with the guide rails 220, 222 to the bottom surface 28 of the cooking appliance 12.

Figure 20:
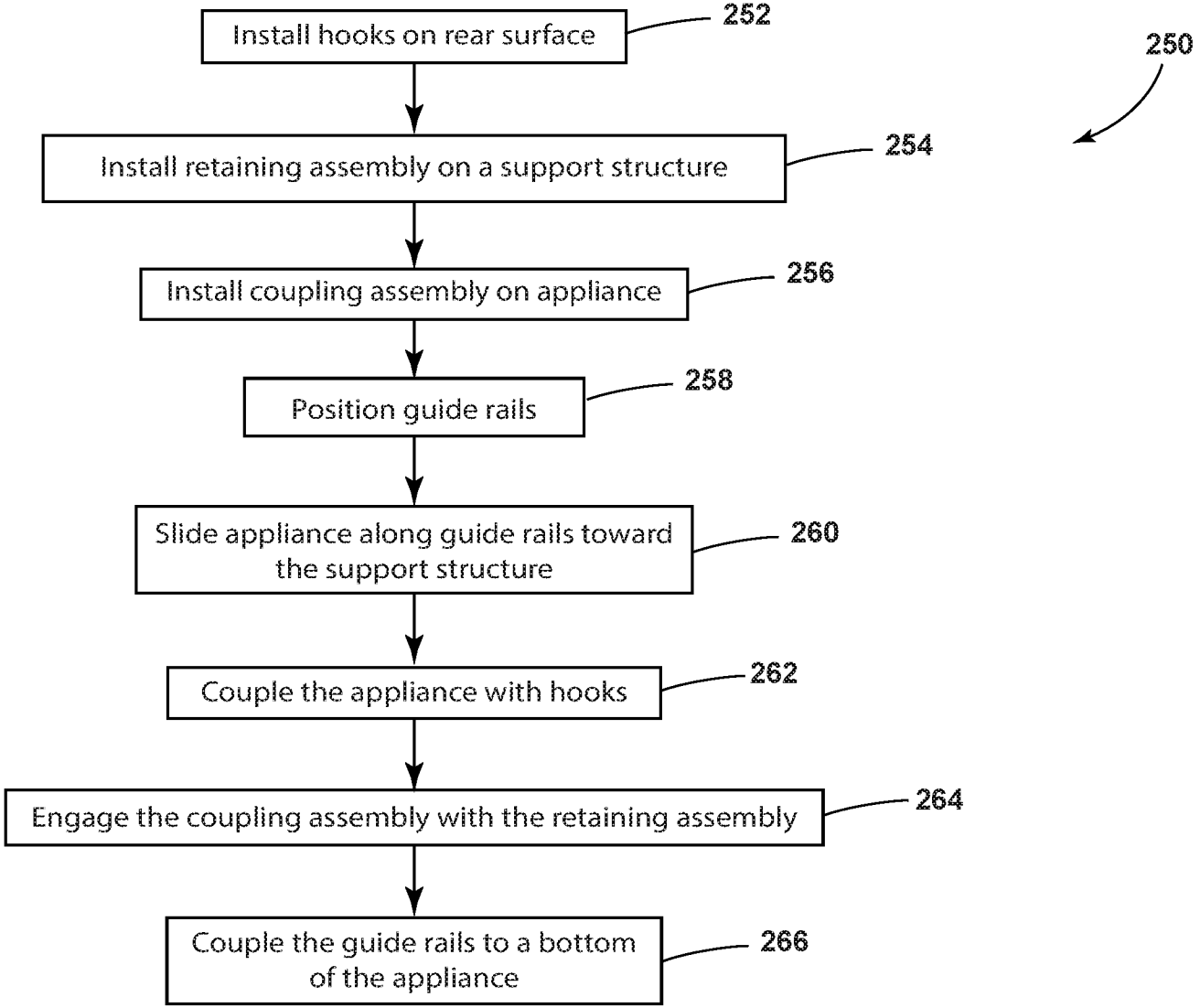
FIG. 20 is a flow diagram of a method of installing a cooking appliance in a hanging position, according to the present disclosure.

Referring to FIG. 20, as well as FIGS. 14-19, a method 250 for installing the cooking appliance 12 with the installation system 10 includes step 252 of installing or coupling hooks 184 on the rear surface 182 within the lower cavity 78. The hooks 184 may be coupled directly to the rear surface 182, or alternatively, the hooks 184 may be part of the back plate 180, which is coupled to the rear surface 182. Further, in step 252, holes may be drilled in the rear surface 182 within the lower cavity 78 to receive fasteners for coupling the hooks 184 and/or the back plate 180. In step 254, the retaining assemblies 42, 44 are coupled to the upper surface 16 of the support structure 14. The retaining assemblies 42, 44 are positioned to align the channels 24 with the first and second apertures 60, 62, respectively. In step 256, the coupling assemblies 46, 48 are coupled with the top surface 26 of the cooking appliance 12. Step 256 may also include coupling the locking features 140 to the respective coupling features 130.

In step 258, the guide rails 220, 222 are positioned to form a slope or angled surface between the lower support feature 224 and the rear surface 182. Step 258 may also include coupling the guide rails 220, 222 to the back plate 180 or the hooks 184. In step 260, the cooking appliance 12 is positioned on the guide rails 220, 222. The bottom surface 28 is positioned to slidably engage the guide rails 220, 222. Additionally or alternatively, in step 260, the bottom surface 28 may engage the guiding features 230 coupled with the guide rails 220, 222. The cooking appliance 12 is pushed at the angle toward the support structure 14 along the guide rails 220, 222. In step 262, the cooking appliance 12 is positioned partially with the lower cavity 78 proximate to the lower surface 18 of the support structure 14. The cooking appliance 12 may be adjusted to engage the bottom surface 28 with the hooks 184. Step 262 may also include aligning the cooking appliance 12 relative to the storage assembly 70. In step 264, the cooking appliance 12 is rotated and further lifted to push the coupling assemblies 46, 48 through the apertures 60, 62 and the retaining assemblies 42, 44, respectively.

In step 266, the guide rails 220, 222 are adjusted to the retracted position 234. The guide rails 220, 222 are then rotated to abut the bottom surface 28 of the cooking appliance 12. The guide rails 220, 222 may be rotated towards the bottom surface 28. Once the guide rails 220, 222 are abutting the bottom surface 28, the guide rails 220, 222 are coupled to the bottom surface 28 to be maintained in a stored position, which is substantially obscured from view. It is understood that the steps of the method 250 may be performed in any order, simultaneously, and/or omitted without departing from the teachings provided herein.

Referring FIGS. 1-20, the installation system 10 may provide features to assist in maneuvering the cooking appliance 12 into the hanging position 40, as well as multiple features for retaining the cooking appliance 12 in the hanging position 40. When in the hanging position 40, a front surface 270 of the cooking appliance 12 is flush or coplanar with the front surface 82 of the cabinet 72, 74, the front edge 80 of the support structure 14, or a combination thereof. The front surface 270 may be substantially planar, for example as illustrated in FIG. 3. Additionally or alternatively, as exemplified in FIG. 11, the cooking appliance 12 may have a rim 272 with a centrally-located recessed region 274, which is generally a transparent portion. The front surface 270 of the rim 272 may be flush with the front surfaces 82 of the cabinets 72, 74. The storage assembly 70 and the cooking appliance 12 may form a continuous front. Further, the cooking appliance 12 may be completely positioned within the lower cavity 78 to provide this flush appearance with the storage assembly 70. When in the hanging position 40, the cooking appliance 12 is suspended from the support structure 14 and spaced from the lower support feature 224.

Use of the present system may provide for a variety of advantages. For example, the installation system 10 may provide a process for installing the cooking appliance 12 that may be accomplished by fewer users, or even a single user. Additionally, when installed in the hanging position 40, the cooking appliance 12 is flush with the front with the adjacent storage assembly 70. Further, the engagement between the coupling assembly 30 and the retaining assembly 22 maintains the cooking appliance 12 in the hanging position 40. Also, the movement of the coupling assembly 30 through the retaining assembly 22 causes the side arms 104, 106 to be adjusted to the extended position 164 to accommodate the coupling assembly 30. Further, the biasing member 112 biases the side arms 104, 106 to the retracted position 160 to engage the locating features 140 and secure the coupling assemblies 46, 48, with the retaining assemblies 42, 44. Further, the cooking appliance 12 may be additionally supported by the hooks 184, which may be coupled directly to the rear surface 182 or part of the back plate 180. Moreover, the installation system 10 may include the guide rails 220, 222 to assist the user in raising the cooking appliance 12 to the support structure 14. Additionally, the guide rails 220, 222 may be telescoping rails configured to be adjusted to the retracted position 234 and coupled to the bottom surface 28 of the cooking appliance 12 for storage. Also, the guide rails 220, 222 may include or be associated with the guiding features 230 to assist in sliding the cooking appliance 12 along the sloped guide rails 220, 222. Additional benefits or advantages may be realized and/or achieved.

The system disclosed herein is further summarized in the following paragraphs and is further characterized by combinations of any and all of the various aspects described therein.

According to another aspect of the present disclosure, an appliance installation system includes a support structure having an upper surface and a lower surface. The support structure defines at least one aperture. At least one retaining assembly is coupled to the upper surface of the support structure. The at least one retaining assembly defines a channel configured to align with the at least one aperture. A cooking appliance has a top surface and a bottom surface. At least one coupling assembly is coupled to the top surface of the cooking appliance. The at least one coupling assembly is disposed within the channel and retained in position by the at least one retaining assembly to install the cooking appliance to the support structure proximate to the lower surface.

According to another aspect, at least one retaining assembly includes a lower cover disposed adjacent to a lower surface of a support structure, an upper cover, a first side arm disposed between the upper cover and the lower cover, and a second side arm disposed adjacent to the first side arm.

According to another aspect, a first side arm and a second side arm are biased to a retracted position to retain at least one coupling assembly within a channel.

According to another aspect, at least one coupling assembly has a locking feature configured to adjust a first side arm and a second side arm to an extended position as the at least one coupling assembly is moved into a channel.

According to another aspect, a telescoping guide rail is selectively coupled to a bottom surface of a cooking appliance. A guiding feature engages the telescoping guide rail and is configured to move between opposing ends of the telescoping guide rail.

According to another aspect, a hook is coupled to a surface proximate to a support structure. The hook is configured to engage a bottom surface of a cooking appliance.

According to another aspect, at least one aperture includes a first aperture spaced from a second aperture, at least one retaining assembly includes a first retaining assembly aligned with the first aperture and a second retaining assembly aligned with the second aperture, and the at least one coupling assembly includes a first coupling assembly coupled to a first side of the cooking appliance and configured to engage the first retaining assembly and a second coupling assembly coupled to a second side of the cooking appliance and configured to engage the second retaining assembly.

According to another aspect, a storage assembly having cabinets is disposed adjacent to a support structure. A front surface of each cabinet is flush with a front surface of a cooking appliance.

According to another aspect, an installation assembly for a cooking appliance includes a retaining assembly defining a channel. The retaining assembly includes a first side arm and a second side arm disposed adjacent to the first side arm. The first side arm and the second side arm are biased to a retracted position. A coupling assembly is configured to couple to the cooking appliance. The coupling assembly includes a coupling feature having an insertion end and a coupling end. A locking feature is coupled to the insertion end. The locking feature has a greater width compared to the coupling feature to adjust the first side arm and the second side arm to an extended position as the coupling assembly is inserted through the channel. The locking feature is retained on the retaining assembly in an installed position.

According to another aspect, a first side arm and a second side arm each have a lip adjacent to a channel. The lips engage a locking feature to retain a coupling assembly in an installed position.

According to another aspect, each of a first side arm and a second side arm is curved to define a channel.

According to another aspect, hooks are coupled to a surface proximate to a retaining assembly and are configured to engage a bottom surface of a cooking appliance when a coupling assembly is in an installed position.

According to another aspect, a retaining assembly includes a first cover, a first bracket coupled to the first cover, a second bracket spaced from the first bracket, and a second cover coupled to the second bracket. A first side arm and a second side arm are disposed between the first bracket and the second bracket.

According to another aspect, a support structure defines an aperture. A retaining assembly is coupled to an upper surface of the support structure and a channel is configured to align with the aperture. A coupling assembly extends through the channel and the aperture when in an installed position.

According to another aspect, a method for installing a cooking appliance includes coupling a coupling assembly to a top surface of a microwave oven, coupling a retaining assembly to an upper surface of a support structure, inserting the coupling assembly through the support structure, automatically adjusting side arms of the retaining assembly to an extended position as the coupling assembly is inserted through the retaining assembly, automatically adjusting the side arms to a retracted position as the coupling assembly is further inserted through the retaining assembly, and retaining the coupling assembly in an installed position on the retaining assembly where the microwave oven is hanging from the support structure.

According to another aspect, a method includes positioning a bottom surface of a microwave oven on hooks coupled to a rear surface adjacent to a support structure.

According to another aspect, a method includes coupling a back plate having hooks to a rear surface proximate to a lower surface of a support structure.

According to another aspect, a method includes positioning rails between a lower support feature and a support structure, sliding a microwave oven along the rails, and rotating the microwave oven to align a coupling assembly with an aperture in a support structure.

According to another aspect, a method includes coupling rails to a bottom surface of a microwave oven.

According to another aspect, a step of retaining a coupling assembly in n installed position includes aligning a front surface of a microwave oven with a front surface of an adjacent storage assembly.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An installation assembly for a cooking appliance, comprising:

a retaining assembly defining a channel, wherein the retaining assembly includes:

a first side arm; and a second side arm disposed adjacent to the first side arm, wherein the first side arm and the second side arm are biased to a retracted position and are disposed between an upper cover and a lower cover of the retaining assembly, wherein each of the first and second side arms form a raised lip adjacent to the channel, and wherein the raised lip of the first side arm and the raised lip of the second side arm extend towards the upper cover; and a coupling assembly configured to couple to said cooking appliance, wherein the coupling assembly includes:

a coupling feature having an insertion end and a coupling end; and a locking feature coupled to the insertion end, wherein the locking feature has a greater width compared to the coupling feature to adjust the first side arm and the second side arm to an extended position as the coupling assembly is inserted through the channel, and wherein the locking feature is positioned on the raised lip of the first side arm and the raised lip of the second side arm in an installed position.

2. The installation assembly of claim 1, wherein each of the first side arm and the second side arm is curved to define the channel.

3. The installation assembly of claim 1, further comprising:

hooks coupled to a surface proximate to the retaining assembly and configured to engage a bottom surface of said cooking appliance when the coupling assembly is in the installed position.

4. The installation assembly of claim 1, wherein the retaining assembly includes a first cover, a first bracket coupled to the first cover, a second bracket spaced from the first bracket, and a second cover coupled to the second bracket, wherein the first side arm and the second side arm are disposed between the first bracket and the second bracket.

5. The installation assembly of claim 4, wherein the first bracket and the second bracket are arranged in a stacked configuration.

6. The installation assembly of claim 4, wherein the first bracket has a U-shaped configuration and the second bracket has a U-shaped configuration, and wherein a pivot axis of the first side arm and the second side arm is aligned with an opening portion of the first bracket and an opening portion of the second bracket.

7. The installation assembly of claim 1, further comprising:

a support structure defining an aperture, wherein the retaining assembly is coupled to an upper surface of the support structure and the channel is configured to align with the aperture, and wherein the coupling assembly extends through the channel and the aperture when in the installed position.

8. A method for installing a cooking appliance, comprising:

coupling a coupling assembly to a top surface of a microwave oven;

coupling a retaining assembly to an upper surface of a support structure;

inserting the coupling assembly through the support structure;

automatically adjusting side arms of the retaining assembly to an extended position as the coupling assembly is inserted through the retaining assembly, wherein the side arms extend at least partially beyond an outer edge of an upper cover of the retaining assembly and an outer edge of a lower cover of the retaining assembly when the side arms are in the extended position;

automatically adjusting the side arms to a retracted position as the coupling assembly is further inserted through the retaining assembly, wherein the side arms are fully positioned within a perimeter defined by both the outer edge of the upper cover and the outer edge of the lower cover when the side arms are in the retracted position; and retaining the coupling assembly in an installed position on the retaining assembly where the microwave oven is hanging from the support structure.

9. The method of claim 8, further comprising:

positioning a bottom surface of the microwave oven on hooks coupled to a rear surface adjacent to the support structure.

10. The method of claim 9, further comprising:

coupling a back plate having the hooks to the rear surface proximate to a lower surface of the support structure.

11. The method of claim 8, further comprising:

positioning rails between a lower support feature and the support structure;

sliding the microwave oven along the rails; and rotating the microwave oven to align the coupling assembly with an aperture in the support structure.

12. The method of claim 11, further comprising:

coupling the rails to a bottom surface of the microwave oven.

13. The method of claim 8, wherein the step of retaining the coupling assembly in the installed position includes aligning a front surface of the microwave oven with a front surface of an adjacent storage assembly.

* * * * *